US007619217B2

(12) United States Patent
Shea et al.

(10) Patent No.: US 7,619,217 B2
(45) Date of Patent: Nov. 17, 2009

(54) HIGH POWER LASER INDUCED ACOUSTIC DESORPTION PROBE

(75) Inventors: Ryan C Shea, Glendale Heights, IL (US); Hilkka I Kenttamaa, West Lafayette, IN (US); Weldon E Vaughn, Lafayette, IN (US); Steven C Habicht, Lafayette, IN (US); James Perez, Trujillo Alto, PR (US)

(73) Assignee: Purdue Research Foundation, West Lafayette, IN (US)

( * ) Notice: Subject to any disclaimer, the term of this patent is extended or adjusted under 35 U.S.C. 154(b) by 359 days.

(21) Appl. No.: 11/807,400

(22) Filed: May 29, 2007

(65) Prior Publication Data

US 2007/0295902 A1 Dec. 27, 2007

Related U.S. Application Data

(60) Provisional application No. 60/808,817, filed on May 26, 2006.

(51) Int. Cl.
*H01J 49/04* (2006.01)

(52) U.S. Cl. ..... 250/288; 250/281; 250/282

(58) Field of Classification Search ..... 250/281, 250/282, 288, 423 R, 424, 425, 423 P
See application file for complete search history.

(56) References Cited

U.S. PATENT DOCUMENTS 5,281,438 A 1/1994 Cottrell et al.
7,211,794 B2 1/2007 Malek et al.
2006/0284074 A1 12/2006 Chang et al.
2007/0131871 A1* 6/2007 Chang et al. ..... 250/427
2008/0156983 A1* 7/2008 Fourrier et al. ..... 250/288

OTHER PUBLICATIONS

Perez et al., "Laser Desorption in Transmission Geometry Inside a Fourier-Transform Ion Cyclotron Resonance Mass Spectrometer", Journal of the American Society for Mass Spectrometry 1999 (10), 1105-1110.*

Lindner, B., "On the Desorption of Electrosprayed Organic Compounds from Supporting Metal Foils by Laser Induced Pressure Waves", Int. J. Mass Spectrom & Ion Processes, 1991 pp. 203-218, 103, Elsevier Science Publishers B.V., Amsterdam.

Golovlev, V.V., Allman, S.L., Garrett, W.R., Taranenko, N.I., Chen, C.H., "Laser-induced acoustic desorption", Int. J. Mass Spectrom & Ion Processes, 1997, pp. 69-78, 169/170, Elsevier Science Publishers B.V., Amsterdam.

Perez, J., Ramírez-Arizmendi, L.E., Petzold, C.J., Guler, L.P., Nelson, E.D., Kenttamaa, H.I., "Laser-induced acoustic desorption/chemical ionization in Fourier-transform ion cyclotron resonance mass spectrometry", Int. J. Mass Spectrom., 2000, pp. 173-188, 198, Elsevier Science Publishers B.V., Amsterdam.

(Continued)

*Primary Examiner*—Jack I Berman
*Assistant Examiner*—Nicole Ippolito Rausch
(74) *Attorney, Agent, or Firm*—Baker & Daniels LLP

(57) ABSTRACT

A high power laser-induced acoustic desorption (LIAD) probe is provided for desorbing neutral molecules from a sample analyte on a target into a mass spectrometer for subsequent ionization.

30 Claims, 19 Drawing Sheets

OTHER PUBLICATIONS

Petzold, C.J., Ramirez-Arizmendi, L.E., Heidbrink, J.L., Perez, J., Kenttamaa, H.I., "Gas-phase Reactions of Charged Phenyl Radicals with Neutral Biomolecules Evaorated by Laser-induced Acoustic Desorption", J. Am. Soc. Mass Spectrom, 2002, pp. 192-194, 13, Elsevier Science Publishers B.V., Amsterdam.

Campbell, J.L., Crawford, K.E., Kenttamaa, H.I., "Analysis of Saturated Hydrocarbons by Using Chemical Ionization Combined with Laser-Induced Acoustic Desorption/Fourier Transform Ion Cyclotron Resonance Mass Spectrometry", Anal. Chem. 2004, pp. 959-963, 76, American Chemical Society, published on Web Jan. 9, 2004.

Campbell, J.L., Fiddler, M.N., Crawford, K.E., Gqamana, P.P., Kenttamaa, H.I., "Analysis of Polyethylene by Using Cyclopentadienyl Cobalt Chemical Ionization Combined with Laser-Induced Acoustic Desorption/Fourier Transform Ion Cyclotron Resonance Mass Spectrometry", Anal. Chem. 2005, pp. 4020-4026, 77, American Chemical Society, published on Web May 18, 2005.

Crawford, K.E., Campbell, J.L., Fiddler, M.N., Duan, P., Qian, K., Gorbaty, M.L., Kenttamaa, H.I., "Laser-Induced Acoustic Desorption/Fourier Transform Ion Cyclotron Resonance Mass Spectrometry for Petroleum Distillate Analysis", Anal. Chem., 2005, pp. 7916-7923, 77, American Chemical Society, published on Web Nov. 9, 2005.

Liu, J., Petzold, C.J., Ramirez-Arizmendi, L.E., Perez, J., Kenttamaa, H., "Phenyl Radicals React with Dinucleoside Phosphates by Addition to Purine Bases and H-Atom Abstraction from a Sugar Moiety", J. Am. Chem. Soc., 2005, pp. 12758-12759, 127, American Chemical Society.

Shea, R.C., Petzold, C.J., Campbell, J.L., Li, S., Aaserud, D.J., Kenttamaa, H.I., "Characterization of Laser-Induced Acoustic Desorption Coupled with a Fourier Transform Ion Cyclotron Resonance Mass Spectrometer", Anal. Chem., 2006, pp. 6133-6139, 78, American Chemical Society, published on the Web Aug. 2, 2006.

Peng, W., Yang, Y., Kang, M., Tzeng, Y., Nie, Z., Change, H., Chang, W., Chen, C., "Laser-Induced Acoustic Desorption Mass Spectrometry of Single Bioparticles", Angew. Chem. Int. Ed., 2006, pp. 1423-1426, 45, Wiley-VCH Verlag GmbH & Co., KGaA, Weinheim,.

* cited by examiner 4 mJ/pulse
10 mJ/pulse
14 mJ/pulse
80
237 ($y_2$)
242 ($b_3$)
316
407, $MH^+$
Abundance (scaled)
m/z
1000
750
500
250
0
1200
900
600
300
2000
1500
50
100
150
200
250
300
350
400
450
500

Scheme 1

Scheme 2

Scheme 3

HIGH POWER LASER INDUCED ACOUSTIC DESORPTION PROBE

CROSS REFERENCE TO RELATED APPLICATION

This application claims the benefit of U.S. Provisional Application Ser. No. 60/808,817, filed on May 26, 2006, which is expressly incorporated by reference herein.

BACKGROUND AND SUMMARY OF THE INVENTION

The present invention relates to an improved evaporation method for use with a mass spectrometer. More particularly, the present invention relates to high-power laser-induced acoustic desorption (LIAD) mass spectrometry probe designed to be coupled to a mass spectrometer for the subsequent ionization and analysis of non-volatile, thermally labile analytes.

The LIAD probe of the present invention improves the desorption efficiency of molecules having larger molecular weights through the use of higher laser irradiances. Energy from the laser pulses propagates through a metal foil or some other target, likely as an acoustic wave, resulting in desorption of neutral molecules from an opposite side of the foil into a mass spectrometer. As used herein, the term LIAD is intended to cover devices which supply energy from a laser to the back side of a target (such as a metal foil or other suitable target) having an analyte on the opposite side, regardless of whether or not an acoustic wave causes the desorption. Following desorption, the molecules are ionized by electron impact, chemical ionization or other suitable method. The mass spectrometer then measures the masses and relative concentrations of the ionized atoms and/or molecules.

Illustratively, the probe of the present invention increases the power density of the pulses applied to the metal foil compared to conventional LIAD probes. Illustratively, over a half of an order of magnitude greater power density (up to at least $5.0\times10^9$ W/cm$^2$) is achievable on the backside of the foil with the high-power LIAD probe of the present invention compared to the conventional LIAD probes which have a maximum power density of $9.0\times10^8$ W/cm$^2$.

According to an illustrated embodiment of the present invention, a laser-induced acoustic desorption (LIAD) probe is configured to desorb neutral molecules into a mass spectrometer. The probe includes a body portion having an interior region, a first end, and a second end configured to be inserted into a mass spectrometer. The probe also includes a window coupled to the second end of the body portion, a laser configured to generate a laser beam which passes into the first end of the body portion and through the window along a desorption axis, and a movable sample holder located adjacent the second end of the body portion spaced apart from the window. The movable sample holder is configured to receive a target having an analyte sample thereon and to move the target relative to the desorption axis so that different portions of the target and analyte sample thereon move into the path of the laser beam during a desorption process.

In one illustrated embodiment, a controller moves the sample holder in X and Y directions within a plane transverse to the desorption axis. In another illustrated embodiment, a controller rotates the sample holder about an axis of rotation spaced apart from the desorption axis.

According to another illustrated embodiment of the present invention, a method of desorbing a analyte sample into a mass spectrometer using laser-induced acoustic desorption (LIAD) comprises providing a LIAD probe to supply a laser beam along a desorption axis, providing a target having an analyte sample located thereon, positioning the target in the path of the laser beam, and providing relative movement between the desorption axis and the target so the different portions of the target and analyte sample are aligned with the desorption axis during a desorption process.

In an illustrated embodiment, the method further comprises ionizing neutral molecules desorbed from the analyte sample on the target after the desorption process.

In one illustrated embodiment, the step of providing relative movement between the desorption axis and the target includes rotating the target about an axis of rotation spaced apart from the desorption axis. In another illustrated embodiment, the step of providing relative movement between the desorption axis and the target includes rotating the LIAD probe relative to the target about an axis of rotation spaced apart from the desorption axis. In yet another illustrated embodiment, the step of providing relative movement between the desorption axis and the target includes moving the target in X and Y directions within a plane transverse to the desorption axis.

According to yet another illustrated embodiment of the present invention, a laser-induced acoustic desorption (LIAD) apparatus is configured to desorb neutral molecules into a mass spectrometer. The apparatus comprises a laser which generates a laser beam, and a probe including a body portion having an interior region, a first end, and a second end configured to be inserted into a mass spectrometer. The probe also includes a window coupled to the second end of the body portion and a target holder located adjacent the second end of the body portion spaced apart from the window. The body portion is positioned relative to the laser so that the laser beam enters the first end directly without the use of a fiber optic line, passes through the window, and strikes a target held by the target holder to desorb neutral molecules from an analyte sample on the target.

In one illustrated embodiment, the apparatus further comprises a frame coupled to the laser, an external focusing lens coupled to the frame, and at least one external mirror coupled to the frame. The at least one external mirror is aligned to reflect a laser beam emitted from the laser through an opening in the first end of the probe.

Also in an illustrated embodiment, the apparatus further comprises an internal focusing lens located in the interior region of the body portion, and first and second internal mirrors located within the interior region of the body portion. The first and second internal mirrors are positioned to reflect the laser beam entering the first end of the body portion to change an axis of the laser beam within the body portion from an entry axis to a spaced apart desorption axis, the desorption axis passing through the internal focusing lens, the window, and the target holder.

In one illustrated embodiment, the body portion includes an inner cylinder and an outer cylinder rotatable relative to the inner cylinder. The inner cylinder, the first and second internal mirrors, and the focusing lens are held in a fixed position. The outer cylinder and the target holder are rotatable about an axis of rotation spaced apart from the desorption axis to move the target relative to the desorption axis during a desorption process.

In another illustrated embodiment, the body portion includes an outer cylinder and an inner cylinder rotatable relative to the outer cylinder. The outer cylinder and the target holder are held in a fixed position. The inner cylinder, the first and second internal mirrors, and the focusing lens are rotatable about an axis of rotation spaced apart from the desorption axis to move the desorption axis relative to the target during a desorption process.

According to still another illustrated embodiment of the present invention, a method of desorbing a sample into a mass spectrometer using laser-induced acoustic desorption (LIAD) is provided. The method comprises providing a target having first and second sides, providing an analyte sample on the first side of the target, positioning the target adjacent a portion of the mass spectrometer, and desorbing neutral molecules from the analyte sample on the first side of the target using a high power LIAD probe to focus a laser beam along a desorption axis and generate a power density greater than $9\times10^8$ W/cm$^2$ on the second side of the target.

In an illustrated embodiment, the method further comprises ionizing the neutral molecules after the desorbing step.

In a certain illustrated embodiment, the power density generated by the probe on the second side of the target is greater than $1.0\times10^9$ W/cm$^2$. In another illustrated embodiment, the power density generated by the probe on the second side of the target is greater than $2.5\times10^9$ W/cm$^2$. Preferably the power density generated by the probe on the second side of the target has a ranges from about $9\times10^8$ W/cm$^2$ to about $5.0\times10^9$ W/cm$^2$.

The probe generates a plurality of laser pulses on the second side of the target. In the illustrated embodiments, the pulses have an energy of greater than 4.5 mJ/pulse, greater than 6 mJ/pulse, and greater than 8 mJ/pulse. Preferably, the pulses having an energy range of about 4 mJ/pulse to about 13 mJ/pulse.

In certain illustrated embodiments, the analyte is a peptide having a molecular weight greater than 500 amu, greater than 750 amu, or greater than 1000 amu. In other illustrated embodiments, the analyte is a hydrocarbon polymer having a molecular weight greater than 1200 amu, greater than 1500 amu, or 1700 amu or greater.

BRIEF DESCRIPTION OF THE DRAWINGS

The detailed description particularly refers to the accompanying figures in which:

FIG. 12(*b*) illustrates a negative-ion LIAD/CI mass spectrum of polyisobutylene-succinic anhydride (PIBSA) evaporated by the LIAD probe of the present invention with 50 laser shots of 8 mJ/pulse at back of foil and deprotonated with bromide ($Br^-$);

FIG. 13(*b*) illustrates a LIAD/CI mass spectrum of polyisobutylene phenol (PIB-Phenol) evaporated by the LIAD probe of the present invention using 50 laser shots of 8 mJ/pulse at back of foil and ionized by addition of $CpCO^+$.;

FIG. 18(*b*) illustrates a reaction of dGuanosine (MW 267), evaporated by the LIAD probe of the present invention using 200 laser shots of 4 mJ/pulse at back of foil, with N-methyl-6,8-didehydroquinolinium ion;

FIG. 20(*b*) illustrates a reaction of dAdenosine (MW 251) evaporated by the LIAD probe of the present invention using 200 laser shots of 4 mJ/pulse at back of foil, with N-methyl-6,8-didehydroquinolinium ion.

DETAILED DESCRIPTION OF THE DRAWINGS

For the purposes of promoting an understanding of the principles of the invention, reference will now be made to certain illustrated embodiments and specific language will be used to describe the same. It will nevertheless be understood that no limitation of the scope of the invention is thereby intended. Such alterations and further modifications of the invention, and such further applications of the principles of the invention as described herein as would normally occur to one skilled in the art to which the invention pertains, are contemplated, and desired to be protected in the claims.

Figure 14:
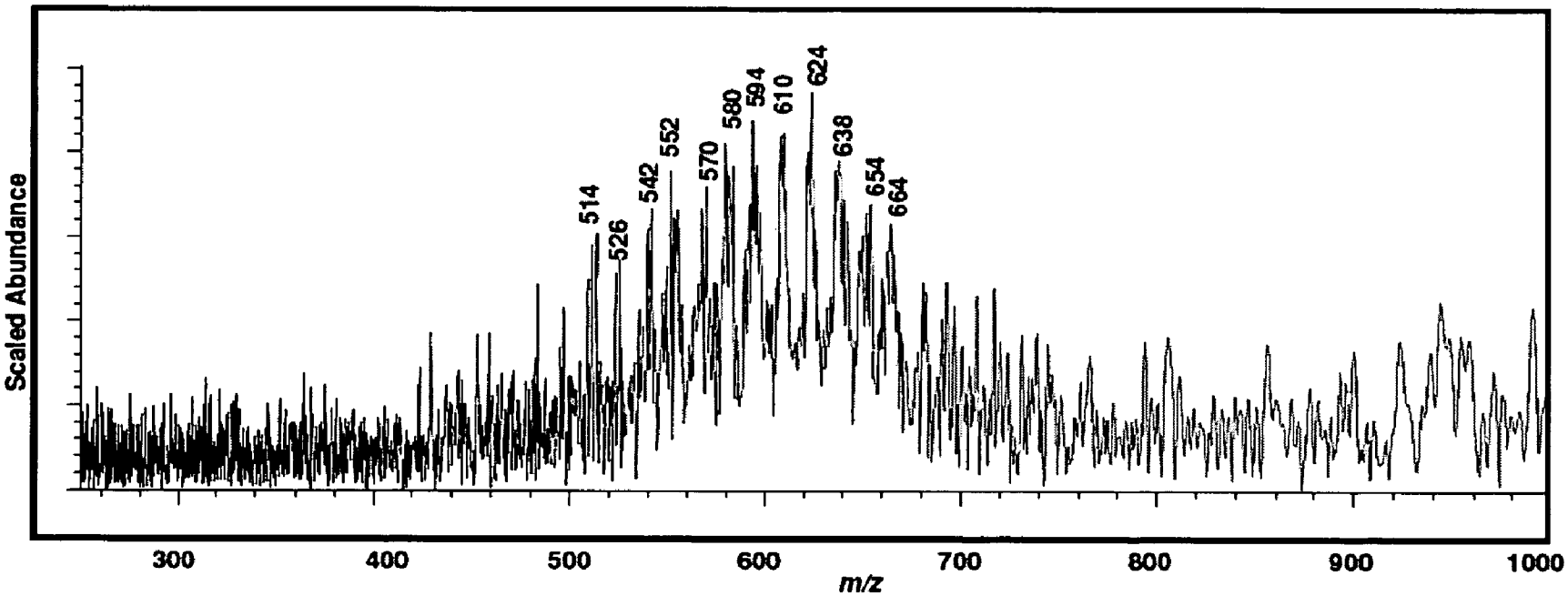
FIG. 14 illustrates a LIAD/EI mass spectrum of petroleum saturates evaporated by the LIAD probe of the present invention using 50 laser shots of 8.5 mJ/pulse at back of foil and ionized by 20 eV EI with ejection of ions m/z 17 to 400.

Referring now to the drawings, FIGS. 14 illustrate a high power laser-induced acoustic desorption system 10 of the present invention which is configured to be coupled to a mass spectrometer 12. The mass spectrometer 12 is illustratively a conventional FT-ICR mass spectrometer equipped with a superconducting magnet 14. In an illustrated embodiment, a dual cell 16 is located within the mass spectrometer 12. The illustrated dual cell 16 includes a source cell and an analyzer cell. Dual cell 16 also includes a source trap plate 34 located within the mass spectrometer 12 adjacent an end portion of LIAD probe 30. A magnetic field is introduced along a central axis of the dual cell 16. Desorbed neutral molecules 36 from a LIAD probe 30 are introduced into mass spectrometer 12 adjacent one end of dual cell 16.

Also in the illustrated embodiment, the mass spectrometer 12 includes diffusion pumps 18, ion gauges 20, inlet valves 22, and electron filaments 24. Details of the mass spectrometer 12 are well known in the art and are also discussed below and in U.S. Provisional Application Ser. No. 60/808,817, filed May 26, 2006, which is incorporated herein by reference. Although certain illustrated mass spectrometers are described herein, it is understood that the LIAD probe system described herein is not limited to the illustrated embodiments and can be used with any suitable mass spectrometers.

A laser-induced acoustic desorption (LIAD) probe 30 is coupled to an inlet 22 of mass spectrometer 12. Details of the LIAD probe 30 are best shown in FIGS. 24 discussed below. During operation, desorbed neutral molecules 36 with low internal and kinetic energies are introduced into the dual cell 16 by the probe 30.

A laser 40 provides a laser beam 48 external to the LIAD probe 30. Illustratively, laser 40 is a Nd:YAG laser (532 nm). The beam 48 is illustratively reflected by first and second external alignment mirrors 42 and 44 through a focusing lens 46 into an inner cylinder 52 of LIAD probe 30. Although certain illustrated lasers are described herein, it is understood that the LIAD probe system described herein is not limited to the illustrated embodiments and can be used with any suitable lasers.

Illustratively, mirrors 42 and 44 are high-energy reflecting mirrors (CVI, 25 mm diam.). The mirrors 40, 42 are illustratively secured to a laser table or frame 39 mounted onto a chassis of the mass spectrometer 12. A long focal length lens 46 (illustratively a Melles-Griot, 1000 mm f.l.) is positioned in the beam path 48 to prevent further divergence of the beam 48 and improve throughput through the mirror assembly. The chassis mounted laser table or frame 39 extends an adequate distance from an inlet of probe 30 for easy removal of the LIAD probe 30 from the instrument without disturbing the external optics. This enables one to easily exchange targets 78 such as sample foils and then reinsert the LIAD probe 30 into the instrument 12 without realignment of the laser beam 48.

Alignment of the internal and external optics of the LIAD probe 30 is required upon installation. Once the optics are appropriately aligned, a minimal amount of adjustment of the external components (mirrors 42, 44 and long focal length lens 46) and no adjustment of the internal components (reflection mirrors 60, 62 and focusing lens 72) is required for daily operation of the LIAD probe 30.

Figure 2:
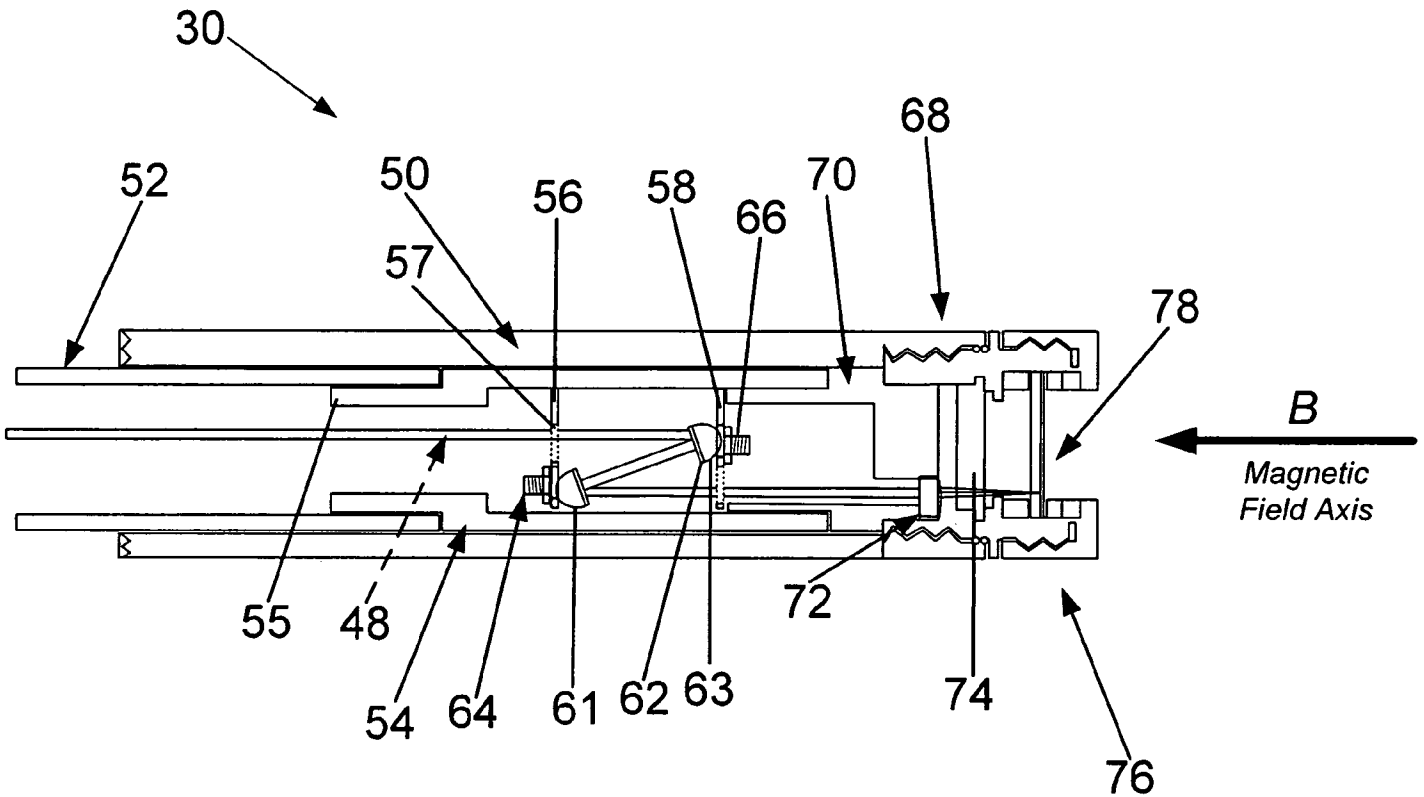
FIG. 2 is a diagrammatical view of an end portion of the LIAD probe of the present invention illustrating laser beam reflection and focusing regions of the LIAD probe.

The LIAD probe 30 illustratively includes an outer cylinder 50 coupled to the inner cylinder 52. Outer cylinder 50 is illustratively formed from stainless steel. A mirror assembly coupler 54 is located within the outer cylinder 50. An end portion 55 of mirror assembly coupler 54 overlaps an end of inner cylinder 52 as shown in FIG. 2. Spaced apart mirror holders 56 and 58 are coupled to the mirror assembly coupler 54. Mirrors 60 and 62 are illustratively coupled to mirror holders 56 and 58, respectively, by ball and socket mounts 61 and 63 and fasteners 64 and 66, respectively, which facilitate rotational adjustment of mirrors 60 and 62. The mirror holders 56, are illustratively secured to each other with a set of three stainless steel rods. The distance between the holders 56, 58 can be adjusted in order to vary the distance between the two mirrors 60, 62.

Figure 4:
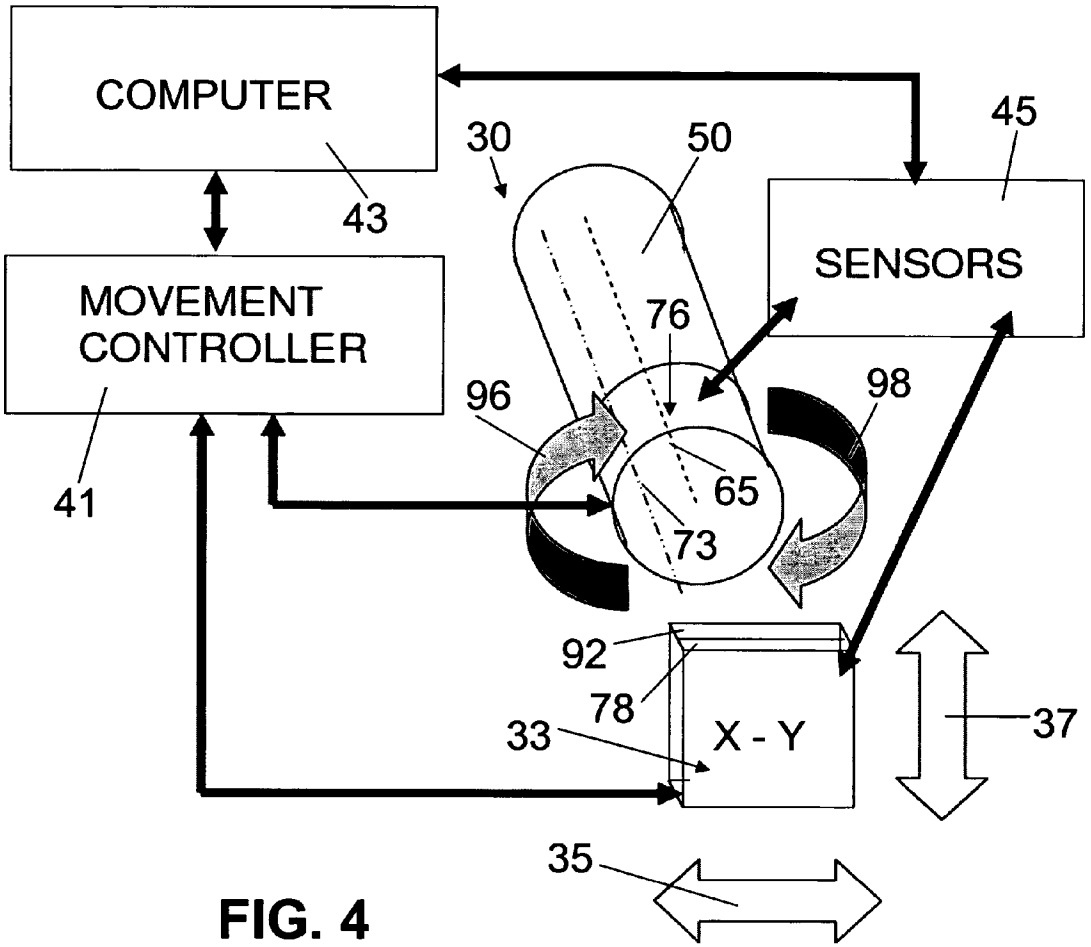
FIG. 4 is a diagrammatical view illustrating movement of a sample relative to the end of the LIAD probe so that different portions of the sample are aligned with a focused laser beam of the LIAD probe of FIGS. 2 and 3.

Laser beam 48 from laser 40 enters the LIAD probe 30 along a central longitudinal axis 65 of the probe 30 and passes through an aperture 57 formed in mirror holder 56. Beam 48 is then reflected by mirror 62 onto mirror 60. Mirror 60 reflects the beam 48 through an aperture 59 in mirror holder 58. As best illustrated in FIG. 4, the mirrors 60 and 62 are positioned to direct the laser beam 48 along to an appropriate desorption axis 73. FIG. 4 illustrates that the desorption axis 73 is spaced apart from the central longitudinal axis 65 of probe 30 by a distance 94.

Figure 3:
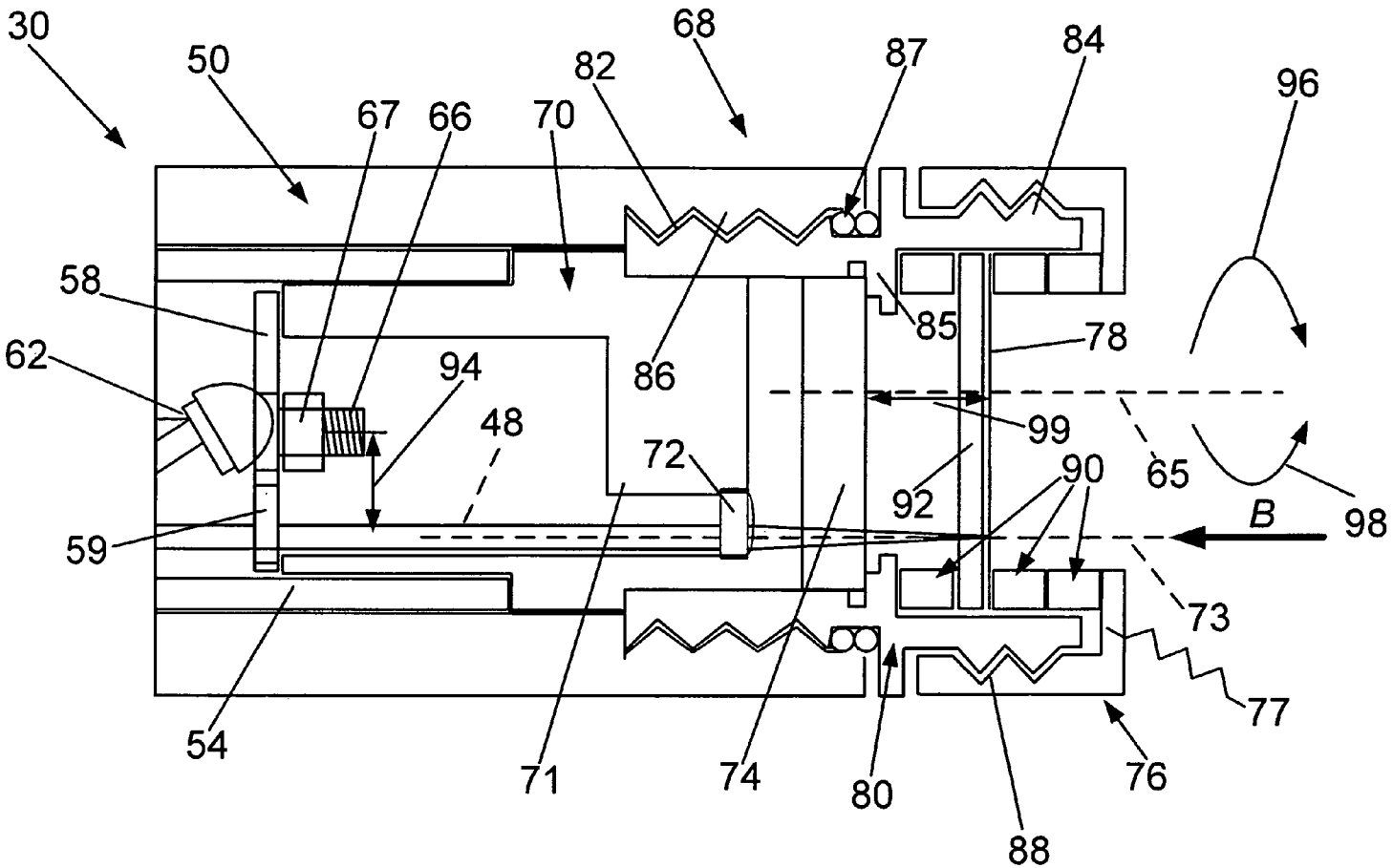
FIG. 3 is an enlarged view of a portion of FIG. 2 illustrating an end of the LIAD probe in more detail.

After passing through aperture 59 in mirror holder 58, the beam 48 passes through an aperture 71 formed in a focusing lens holder 70. A focusing lens 72 is coupled to the focusing lens holder 70 within aperture 71 so that the beam 48 passes through the focusing lens 72 as best shown in FIG. 3. Focusing lens 72 focuses beam 48 along desorption axis 73.

A threaded sample holder or target holder 80 is coupled to an end portion 68 of outer cylinder 50 as shown in FIGS. 2 and 3. Target holder 80 includes first and second threaded portions 82 and 84. Threaded portion 82 is configured to be coupled to threads 86 formed in the end portion 68 of outer cylinder 50. 0-ring seals 87 illustratively are located between the outer cylinder 50 and the target holder 80. A fused silica window 74 is coupled to target holder 80 adjacent a radially inwardly extending rib 85 of holder 80. Illustratively, window 74 is vacuum sealed to holder 80 by an epoxy, or other suitable method. The sealed window 74 maintains vacuum integrity between the high vacuum region ($<10^{-9}$ torr) of the mass spectrometer 12 and the atmospheric region inside the probe 30 when inserted into the mass spectrometer 12.

An end cap 76 includes internal threads 88 which are coupled to threads 84 of target holder 80. Cap 76 also includes a radially inwardly extending flange 77. A target 78 such as a sample foil and glass 92 are retained on target holder 80 by cap 76. Teflon® spacers 90 are located between the rib 85 of holder 80 and the flange 77 of cap 76 to position the target 78 at a desired distance 99 from window 74.

In an illustrated embodiment, the outer cylinder 50 of LIAD probe 30 is rotated within a high vacuum sealed sample lock of the mass spectrometer 12. The internal mirrors 60 and 62 of probe 30 align the beam 48 with the magnetic field axis illustrated by arrow B which is located at a center of dual cell 16. The inner cylinder 52, mirror assembly coupler 54, and focusing lens holder 70 are illustratively held in a fixed position. The outer cylinder 50, target holder 80, cap 76, target 78 and glass 92 all rotate about axis 65 as illustrated by arrows 96 and 98 in FIGS. 3 and 4. Therefore, the target 78 is rotated to move different portions of the target 78 into the path of beam 48 on desorption axis 73.

In another illustrated embodiment, the outer cylinder 50 and the target holder 80 are held in a fixed position and the inner cylinder 52, the first and second internal mirrors 60 and 62, and the focusing lens 72 are rotatable about an axis of rotation spaced apart from the desorption axis 73 to move the desorption axis 73 relative to the target 78 during a desorption process.

The LIAD probe 30 utilizes laser 40 to desorb neutral analyte molecules from the sample on the target 78 into the mass spectrometer 12. Illustratively, a thin layer of the analyte is deposited onto a thin (12.7 μm) foil target 78. Preferably, foil of target 78 is made from Titanium. It is understood that any suitable targets made from any suitable material may be used with the illustrated system and methods. The backside of foil target 78 is illustratively irradiated by a series of short (3 ns) high intensity laser pulses (532 nm). It is understood that other pulse widths and wavelengths may be used depending upon the application, materials, or the like. Upon striking the back side of the target 78, the laser energy is propagated through the target 78, resulting in desorption of neutral analyte molecules from the opposite side of the target 78 into the mass spectrometer 12. Ionization of the desorbed molecules by well characterized chemical reactions has been demonstrated to be an effective approach for the analysis of such compounds, although it is understood that other suitable ionization methods may be used.

In another illustrated embodiment of the present invention, an improvement is provided to increase the fraction of the total amount of sample on the foil that can be used in each LIAD experiment. Currently, after 360° rotation of the LIAD probe outer cylinder 50 with complete sample desorption, only about 5% of the total surface coverage of the sample foil target 78 is used. In another illustrated embodiment of the present invention illustrated in FIG. 4, a sample cartridge 33 is movable in horizontal and vertical (X-Y) directions to facilitate a raster pattern and thus improve the fraction of sample used per analysis. Sample preparation is illustratively the same as discussed above of depositing the desired material onto a suitable target, such as a 12.7 μm thick foil target 78, or other suitable target. The target 78 and a thin glass barrier (about 200 μm thick) are then pressed between two plates or otherwise coupled to the sample cartridge. The beam from the laser 40 is guided via a converging lens to a fixed focusing lens that concentrates the beam to a spot on the backside of the foil to accomplish LIAD. The beam spot would thus remain stationary while the X-Y cartridge 33 containing the sample cartridge is moved in a raster pattern or other desired pattern.

FIG. 4 illustrates a controller for controlling rotation of the outer cylinder 50 about axis 65 in the directions of arrows 96 or 98 as discussed above. A movement controller 41 is coupled to cylinder 50 to provide controlled rotation about central axis 65. Sensors 45 detect the position of cylinder 50 providing feedback to a computer 43 which is also coupled to the movement controller 41. As the outer cylinder 50 rotates relative to the desorption axis 73, different portions of the sample on foil target 78 are moved through the laser beam 48 on the desorption axis 73. Once outer cylinder 50 is rotated 360°, a complete circular pattern is provided on the target 78. As discussed above, the circular pattern on the target 78 results in only about 5% of the total surface coverage of the sample being used. Therefore, in another embodiment, a X-Y cartridge 33 is provided for holding and moving target 78.

Illustratively, a target 78 and a spacing glass 92 are located within the cartridge 33. Cartridge 33 is movable by movement controller 41 in the X and Y directions as illustrated by double headed arrows 35 and 37, respectively. Sensors 45 illustratively detect the position of cartridge 33 and provide feedback to computer 43. Computer 43 drives movement controller 41 to move the cartridge 33 in the X and Y directions as the desorption process occurs. Therefore, the target 78 may be at any X-Y position relative to desorption axis 73 so that a substantial portion of the analyte sample on the target 78 is used during the desorption process. In another embodiment, controller 41 controls movement of the probe 30 in the Z direction for controlling automatic insertion and removal of the probe 30 from the mass spectrometer 12. The cartridge 33 may be used in combination with a rotating outer cylinder, or it may be used with a stationary outer cylinder 50 and movable cartridge 33 to selectively position the target 78 relative to the desorption axis 73.

Figure 1:
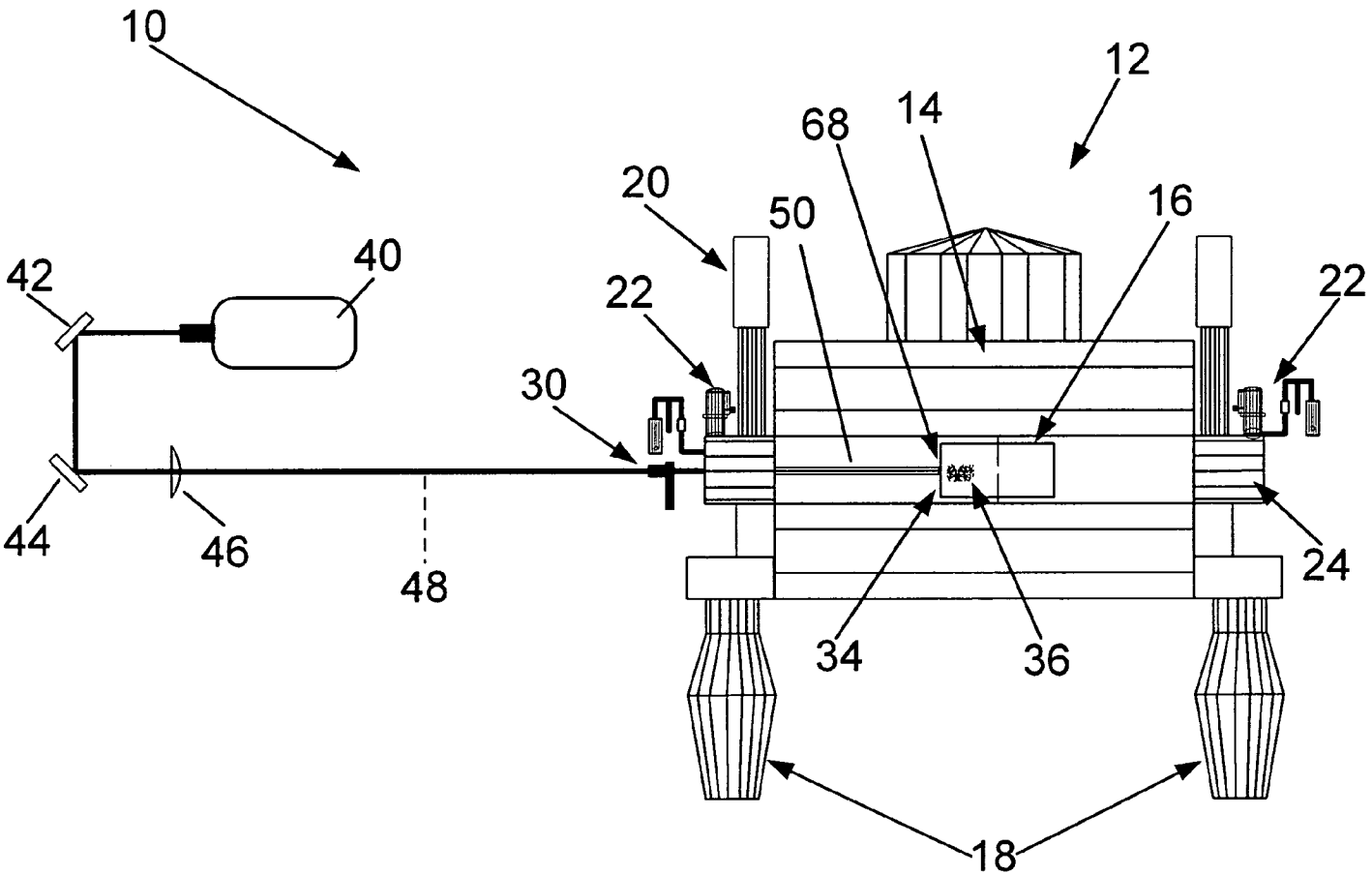
FIG. 1 is a diagrammatical view of a LIAD probe system of the present invention coupled to a mass spectrometer.

It is understood that the rotatable cylinder 50 with a desirable desorption axis 73 or the movable sample cartridge 33 may be used with other types of probes including the fiber connected probe of FIG. 6 below. In other words, the use of the means for moving the target 78 relative to the desorption axis 73 is not limited to the fiberless LIAD probe embodiment shown in FIGS. 1, 2 and 3.

One of the limitations of conventional LIAD techniques used to desorb neutral molecules is the inability to analyze molecules with large molecular weights. For example, the analysis of neutral peptides has been limited to species of less than approximately 500 amu. However, for the analysis of synthetic polymers, a larger high mass limit of approximately 1200 amu applies.

Figure 5:
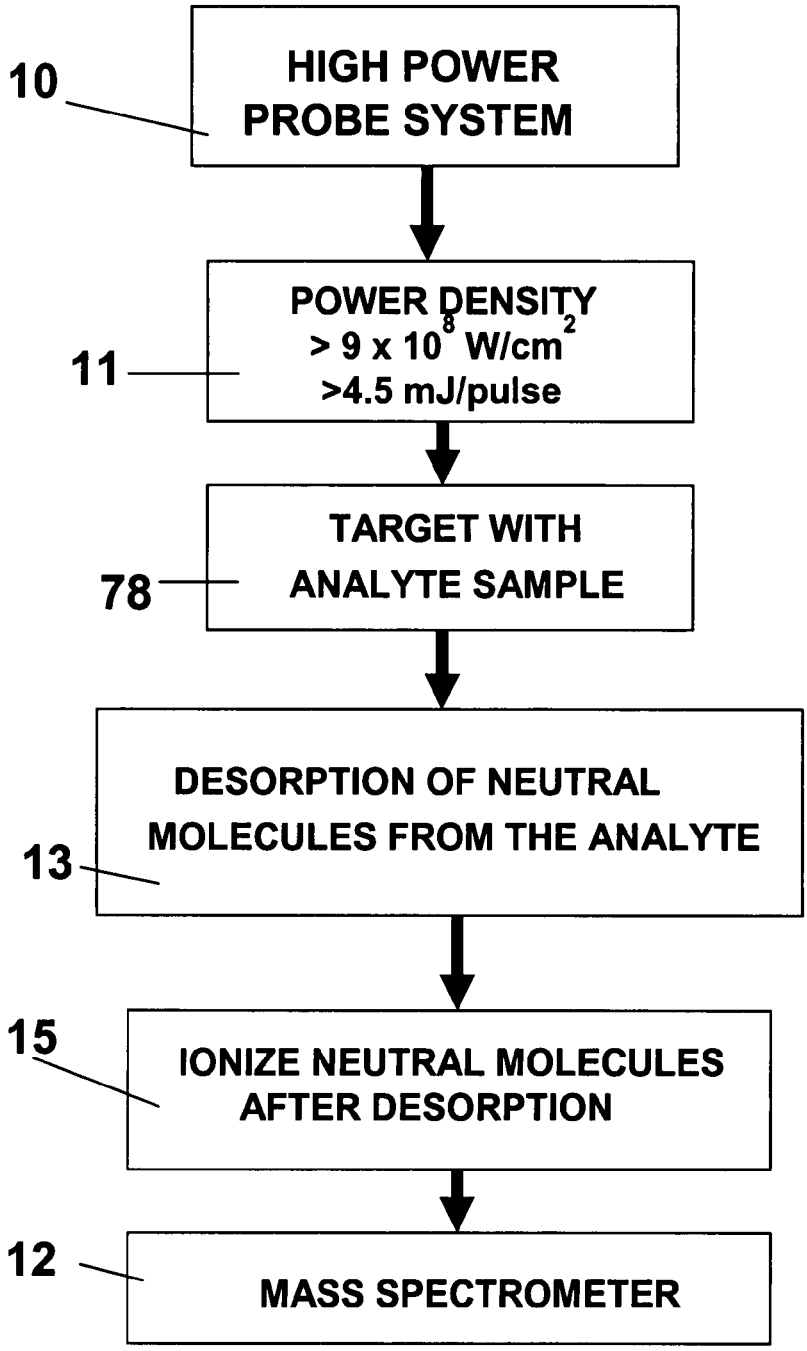
FIG. 5 is a block diagram illustrating the increased power density supplied to the metal foil by the high power LIAD probe of the present invention.

The high power LIAD probe system 10 of present invention provides greater laser irradiances ($>9.0\times10^8$ W/cm$^2$) to improve the desorption efficiency of neutral molecules with larger molecular weights as illustrated at blocks 10 and 11 of FIG. 5. The high power LIAD probe of the present invention provides over a half of an order of magnitude greater power density (up to at least $5.0\times10^9$ W/cm$^2$) on the back side of the target as illustrated at block 78 of FIG. 5 which aides in the evaporation or desorption of neutral molecules with larger molecular weights as illustrated at block 13 of FIG. 5. The high-power laser probe 30 provides high intensity (up to ~25 mJ/pulse) laser pulses onto the backside of target 78 providing increased desorption efficiency for molecules with higher molecular weights as well as the evaporation of more material per laser pulse compared to prior systems. Preferably, the laser pulses at the back side of the target range from about 4.5 mJ/pulse to about 13 mJ/pulse.

In the illustrated embodiment of the present invention the desorbed neutral molecules are ionized after the desorption process as illustrated in block 15 of FIG. 5. This results in greater signals for the ions subsequently generated from the evaporated molecules in the mass spectrometer illustrated at block 12 of FIG. 5. Conventional systems that attempt to ionize the molecules during desorption are less effective than the present system.

Other ways to provide higher intensity laser pulses on the back side of a foil or target 78 include tighter focusing of the laser beam before the foil or target 78, and/or the use of a shorter laser pulse width.

The LIAD probe system 10 of the present invention provides an improvement over prior art LIAD techniques. An example of a prior art LIAD probe 100 is illustrated in FIG. 6. Probe 100 includes an inner cylinder 102 and an outer cylinder 104. A beam from a laser 106 passes through a fiber optic line 108 to a fiber optic output ferrule 110. Output ferrule 110 emits a beam 112 onto a pair of imaging lenses 114. Beam then passes through a quartz window 116 at an end of outer cylinder 104. A sample positioning stage 117 includes an end cap 118 which holds a sample target 120. Teflon® spacers 122 are provided to space the sample target 120 at a desired distance from quartz window 116. As discussed above, due to the limits of fiber optic line 108 and output ferrule 110, the maximum power density of the prior art probe 100 at the foil or target is $9.0\times10^8$ W/cm$^2$.

Experimental Results

Two Fourier-transform ion cyclotron resonance mass spectrometers (FT-ICR) of similar configuration were used for the experiments described here. The experiments were performed using either a Nicolet model FTMS 2000 dual cell FT-ICR or an Extrel model FTMS 2001 dual cell FT-ICR. Each instrument was equipped with a 3 T superconducting magnet and a differentially pumped dual cell. The Nicolet FT-ICR utilized two Edwards Diffstak 160 diffusion pumps (700 L/s), each backed by an Alcatel 2010 (3.2 L/s) dual rotary-vane pump, for differential pumping. The nominal baseline pressure is $<10^{-9}$ torr inside the vacuum chamber, as measured by Bayard-Alpert ionization gauges located on either side of the dual cell 16. The Extrel FT-ICR utilized two Balzer TPU turbomolecular pumps (330 L/s) (each backed by an Alcatel 2010 (3.2 L/s) dual rotary-vane pump) instead of diffusion pumps. The nominal baseline pressure is also $<10^{-9}$ torr inside the vacuum chamber, as measured by Bayard-Alpert ionization gauges located on each side of the dual cell.

Both instruments have manual insertion probe inlets which were also used for the LIAD probe 30. Laser 40 may be a Minilite II, Continuum Laser; 532 nm, 25 mJ/pulse (max), 3 ns pulse width having a beam 48 focused onto the backside of a sample metal foil target 78 over an irradiation area of approximately $10^{-3}$ cm$^2$.

Figure 6:
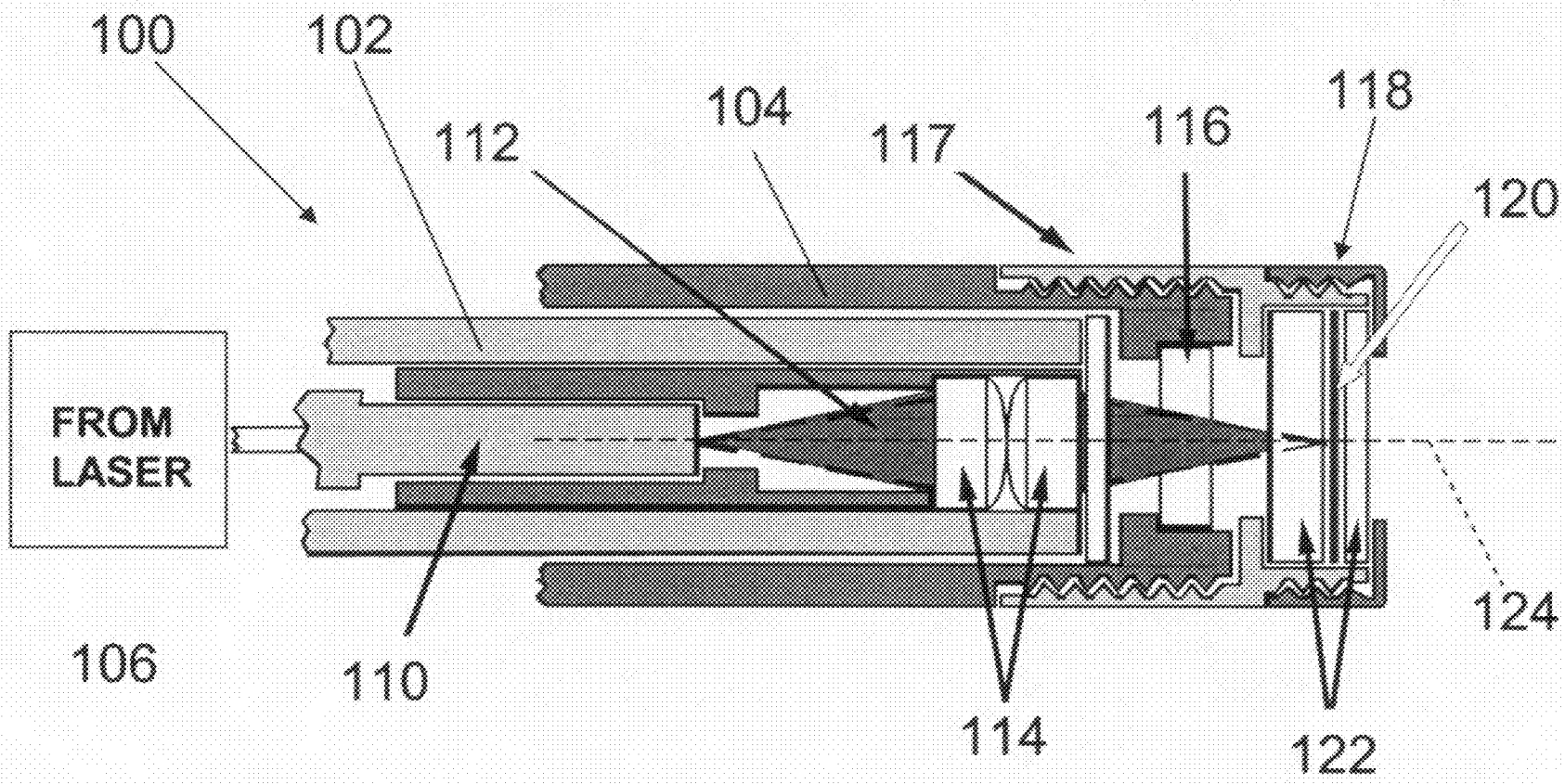
PRIOR ART FIG. 6
FIG. 6 is a view of an end portion of a prior art LIAD probe in which a fiber optic connector is used between the laser and the probe.

As discussed above, the LIAD probe 30 provides over a half-order of magnitude increase in the power density achievable on the backside of the metal foil target 78 compared to conventional probe such as probe 100 illustrated in FIG. 6. With the previous optical fiber containing LIAD probes shown in FIG. 6, achievable power densities were limited to approximately $9.0\times10^8$ W/cm$^2$ on the backside of foil target 78. Due to reflection losses on the mirrors and lenses, as well as beam divergence over the approximately 2 m distance from the laser 40 to the backside of the foil target 78, the measured laser throughput of the present system 10 is limited to approximately ~50% of the input laser power. Upon focusing the laser beam onto the backside of the target 78, power densities up to at least $5.0\times10^9$ W/cm$^2$ are achieved with the LIAD probe 30. This increased power density is thought to result in larger amplitude acoustic waves within the sample foil target 78, which increases desorption efficiency.

Sample solutions (methanol) were prepared in concentrations ranging from 1 to 10 mm, and electrospray deposited onto Ti metal foil targets 78 (1.7 cm diam.). By varying the volume of solution spayed, sample thicknesses ranging from 30 to 85 nmol/cm$^2$ were obtained. The foil target 78 was mounted onto the LIAD probe 30 and inserted into the mass spectrometer 12 to within ⅛" of the source trap plate of the dual cell 16. The foil target 78 was subjected to a series of laser shots focused onto the backside of the foil target 78 while continually rotating the outer cylinder 50 of the probe as discussed above. Depending on the input laser power utilized, power densities on the order of about $1\times10^9$ W/cm$^2$ to about $5\times10^9$ W/cm$^2$ were obtained on the backside of the foil target 78.

Following desorption, the analyte molecules were ionized by either electron impact ionization (EI) or chemical ionization (CI). EI of the desorbed neutral molecules was performed by switching the bias of a grid to allow electrons (70 eV electron energy, 5-10 μA emission current) into the ICR cell during or immediately after the laser trigger event (150-1000 μs). Chemical ionization was achieved by reaction of the desorbed peptide molecules with protonated triethylamine (m/z 102) or diethylaniline (m/z 150) ions stored in the ICR cell. Triethylamine and diethylaniline molecules were introduced through a batch inlet (equipped with an Andonian leak valve) into one side of the FT-ICR dual cell 16. The chemical ionization reagent ions were generated through self-chemical ionization processes. This was performed by allowing the molecular ion and its fragment ions, obtained by electron ionization (70 eV) of the reagent, to react (~2 s) with additional neutral reagent molecules in the cell. The resulting protonated reagent molecules were transferred into the adjacent clean cell through at 2 mm hole in the conductance limit plate by grounding this plate for about 100 μs. Following transfer, the ions were radiatively and collisionally cooled (for approx. 1 s) with a pulse of Ar gas (nominal peak pressure of ~$10^{-5}$ torr in the cell). Unwanted ions were ejected from the cell through the use of stored waveform inverse Fourier transform (SWIFT) excitation pulses leaving the isolated ions of interest in the cell to react with the acoustically desorbed analyte molecules, resulting in ionization.

A broadband chirp (1.9 kHz to 2.6 MHz, 200 V peak-to-peak, sweep rate 3200 Hz/μs) was used to excite the ions for detection. Data was obtained by collecting 64 k data points with an acquisition rate of 8000 kHz. The mass spectra were subjected to baseline correction, Hanning apodization, and one zero-filling.

In another embodiment of the present invention a linear quadrupole ion trap (LIT) mass spectrometer is used with the LIAD probe 30. The LIT mass spectrometer has several qualities that make it popular in both academic and industrial settings, such as high sensitivity, large dynamic range and experimental versatility. Further, the relatively small size of the LIT instrument and the lack of a magnetic field provide some advantages over the FT-ICR instrument.

The LIT mass analyzer, such as a Finnigan® LTQ model, has some distinct features that make it attractive for implementation of LIAD. One feature is the radial detection design. Traditional quadrupole ion trap mass analyzers are aligned so that ions enter through a hole in one end cap, then are trapped via a RF voltage applied to the ring electrode and are ejected through a hole in the other end cap (180° from the entrance hole) to be detected. Modification of this geometry for LIAD involves drilling a hole into the mass analyzer to allow introduction of the desorbed neutral molecules into the trap. However, the LIT device ejects ions radially through exit slits in two of the hyperbolic rods (180° from each other) to the detectors. This leaves the rear of the trap available to further modification. In fact, the back plate of the instrument at the vacuum manifold is removable for attachment of different options offered by the manufacturer (e.g., FT-ICR, ETD) and has also been modified to accept an ESI source. This geometry allows modification of this instrument for LIAD without requiring any significant changes to the mass analyzer.

This modification expands the number of different experiments that can be coupled with LIAD. One example is the types of reagent ions that can be used for LIAD experiments. The LIT device is equipped with an atmospheric pressure ionization source capable of electrospray ionization (ESI) and atmospheric pressure chemical ionization (APCI).

To implement the LIAD process on a LIT mass spectrometer, a flange and sample lock are illustratively mounted to the rear of the instrument to facilitate insertion of the probe. As stated above, the removable backplate of the LIT device facilitates this modification of the instrument with minimal damage to the chassis. A machined metal (e.g., aluminum) housing is then attached to the vacuum manifold. A turbomolecular pump is mounted to the bottom of this housing and is used to provide a differential pumping region ($-10^{-4}$ torr) as a barrier between the mass analyzer and the sample lock. The interior of the housing includes supports (e.g., probe guide rings) to stabilize the probe 30 and maintain alignment of the desorption axis with the center of the trap. The end of the housing parallel to the back of the instrument is illustratively manufactured to accept a flange. The flange may contain a gate valve and sample lock that accept LIAD probe 30. The sample lock is illustratively placed approximately ¼" off center of the flange, which allows for additional sample desorption areas by rotating the outer cylinder 50 of the probe 30. The X-Y cartridge 33 may also be used, if desired. The probe 30 is pumped to the mTorr range prior to insertion with a mechanical pump attached to the sample lock.

This housing provides a differential pumping region to maintain the optimal operating pressure ($0.5-1.5\times10^{-5}$ torr) in the mass analyzer region while inserting the probe. This instrument is designed to operate at a pressure lower than $-1\times10^{-4}$ torr in order to protect the ion gauge in the mass analyzer region. If the pressure increases above this limit, the instrument automatically halts all function and reverts to standby mode. This means that no ion generating events could be carried out while inserting the probe. With the housing region acting as a differentially pumped area, the desired reagent ions can be generated in the trap and are available while inserting the probe. This also facilitates the experiments because the instrument should quickly pump back to its baseline pressure following opening of the gate valve.

As mentioned above, the sample lock is illustratively set about ¼" off center so that the desorption axis of the probe will align with the center of the trap. At the end of the trap is a back lens, which is a metal disk with a hole in the center designed to facilitate the travel of ion beams. This lens is held at +22V during routine operation. The LIAD probe is inserted to within about ⅛" of this back lens to allow for maximum overlap of desorbed neutral molecules with trapped ions (this is the approximate distance currently used in the FT-ICR instruments). This distance may be optimized as needed. A collar is installed on the LIAD probe to prevent insertion of the probe past the determined optimal distance. In another embodiment, an additional back lens is used to increase the diameter of the hole to allow the entry of a larger number of the desorbed neutral molecules or even to allow insertion of the probe closer to the trapping electrodes.

Since the probe is inserted very close to the ion trap assembly, it is electrically isolated from this assembly to prevent interference with the trapping of ions. This isolating is illustratively accomplished by replacing the stainless steel end cap on probe 30 with a Teflon® end cap. Other suitable plastics (e.g., Kel-F, Vespel) may also be used, if desired. The probe supports present in the housing can also be designed to ground the probe.

Increased Desorption Efficiency with Higher Laser Powers

Figure 7:
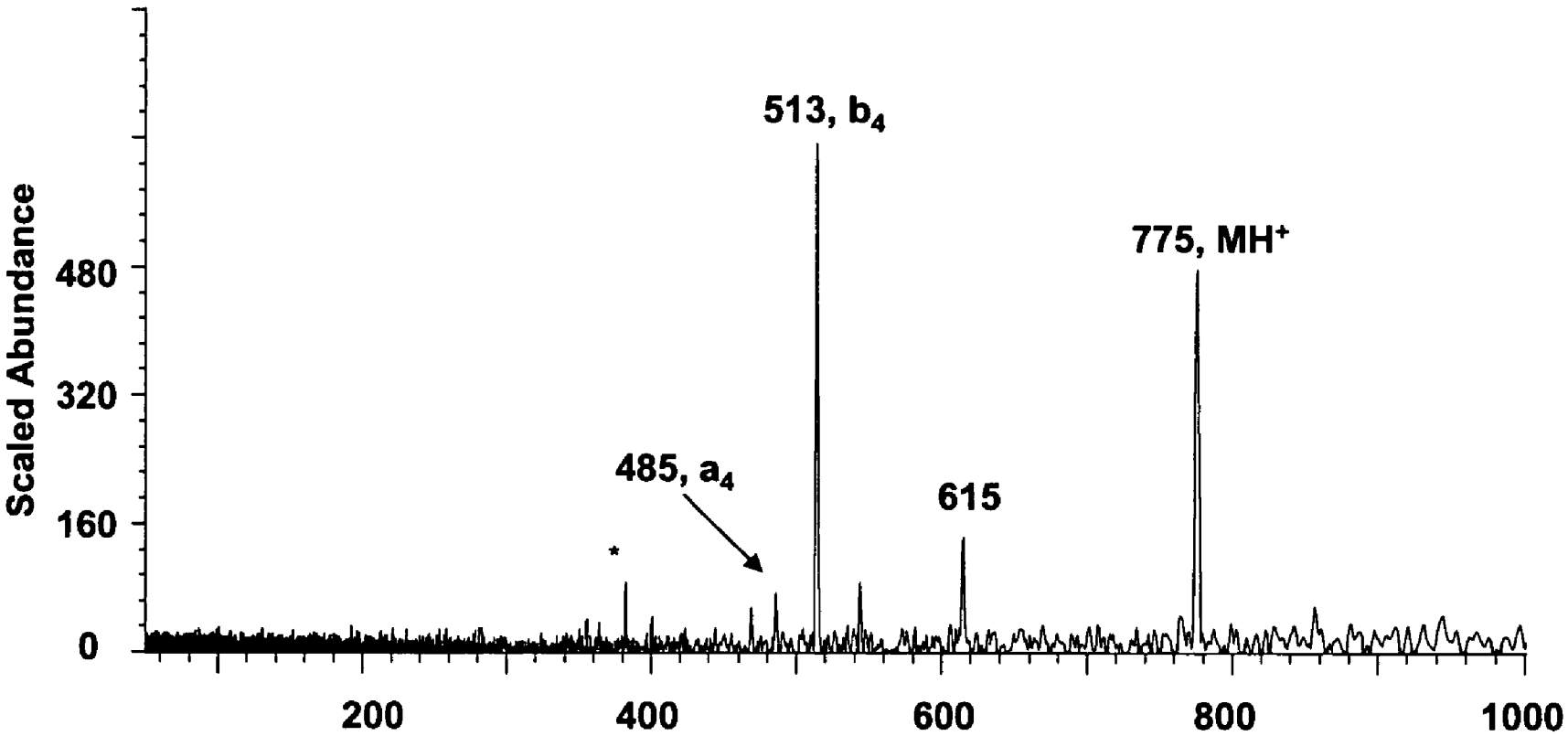
FIG. 7 illustrates a LIAD/CI mass spectrum (200 laser shots) of Angiotensin IV (val-tyr-ile-his-pro-phe, MW 774) obtained by using the LIAD probe of FIGS. 1-2(*b*) and a power density of $2.3\times10^9$ W/cm$^2$ to evaporate the peptide and proton transfer from protonated triethylamine (m/z 102) to ionize it.

The high mass limit for the analysis of peptides with the fiber LIAD probe of FIG. 6 is approximately 500 amu. The use of higher laser irradiances with the LIAD probe 30 of the present invention enables the high mass limit for biological polymers to be expanded. This is demonstrated, for example by the successful analysis of the hexapeptide Angiotensin IV (val-tyr-ile-his-pro-phe MW 774). The peptide was electrospray deposited (67 nmol/cm$^2$) onto 12.7 μm thick Ti foil target 78 and evaporated utilizing 200 laser shots, each with a power density of $2.3\times10^9$ W/cm$^2$ on the backside of the foil target 78. Following desorption, the peptide material was ionized via proton transfer from protonated triethylamine, resulting in generation of the protonated molecule ($MH^+$, m/z 775) and some minor fragment ions, including the $a_4$ (m/z 485) and $b_4$ (m/z 513) ions as shown in FIG. 7. The fragmentation is believed to be caused by the high exothermicity of the protonation reaction, and not the desorption event. Strong signals were obtained with LIAD probe system 10 of the present invention for peptides such as Angiotensin IV, Angiotensin II antipeptide and Angiotensin I $f_1$-$f_7$ which previously could not be analyzed with conventional LIAD techniques. These results demonstrate that the use of higher laser powers improves the desorption efficiency for higher molecular weight peptides and therefore is capable of extending the mass range of LIAD analyses.

The use of higher laser irradiances with the LIAD probe system 10 has also been successfully applied to the analysis of a variety of other thermally labile analytes which could not be analyzed earlier, including nucleic acid components, hydrocarbon polymers and petroleum distillates as discussed further below.

Figure 8:
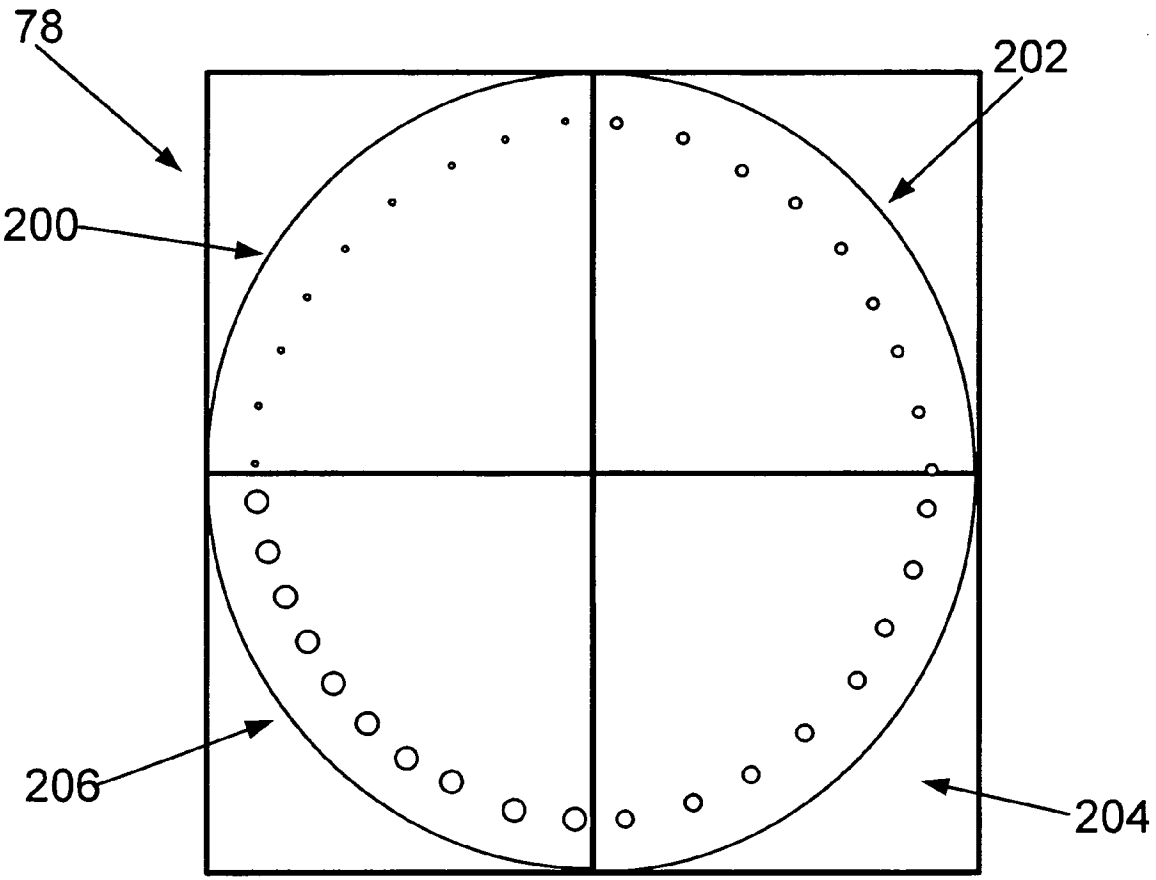
FIG. 8 illustrates portions of four separate sample foils after desorption at different power densities.

An additional benefit of increasing the laser irradiance is an increase in the amount of material evaporated per laser pulse. This is illustrated by FIG. 8, which is a composite illustration of the sample deposition/desorption side of four separate foil targets 78 onto which the MALDI matrix 4-hydroxy-α-cyano cinnamic acid was electrospray deposited (approx. 36 nmol/cm$^2$). As illustrated in FIG. 8, the material of the foil targets 78 was desorbed into the mass spectrometer 12 with single laser pulses of varying energy applied to the backside of the foil targets 78. For the laser irradiances used, the general appearance of the spectra obtained was quite similar. The only observable difference was the increase in intensity of the molecular ion signal with the use of higher laser powers. Power densities ranging from $1.0\times10^9$ W/cm$^2$ to $2.5\times10^9$ W/cm$^2$ were used to desorb the matrix from the foil. Upon examination of the foil following desorption, the use of a moderate power density of $1.0\times10^9$ W/cm$^2$ shown in region 200 applied to the backside of the first foil was found to result in removal of a small amount of material from the foil surface. As the power density is increased to $1.5\times10^9$, $2.0\times10^9$, and $2.5\times10^9$ W/cm$^2$, a significantly greater number of molecules are removed from the surface of the second, third and fourth foil targets 78 per laser pulse as evident by the larger spots on the front side of the foil target 78 in regions 202, 204, and 206, respectively. This qualitative comparison demonstrates that increased laser irradiances aide in the evaporation of more material per laser pulse thus increasing the sensitivity of LIAD analyses.

Figures 9, 10, 11:
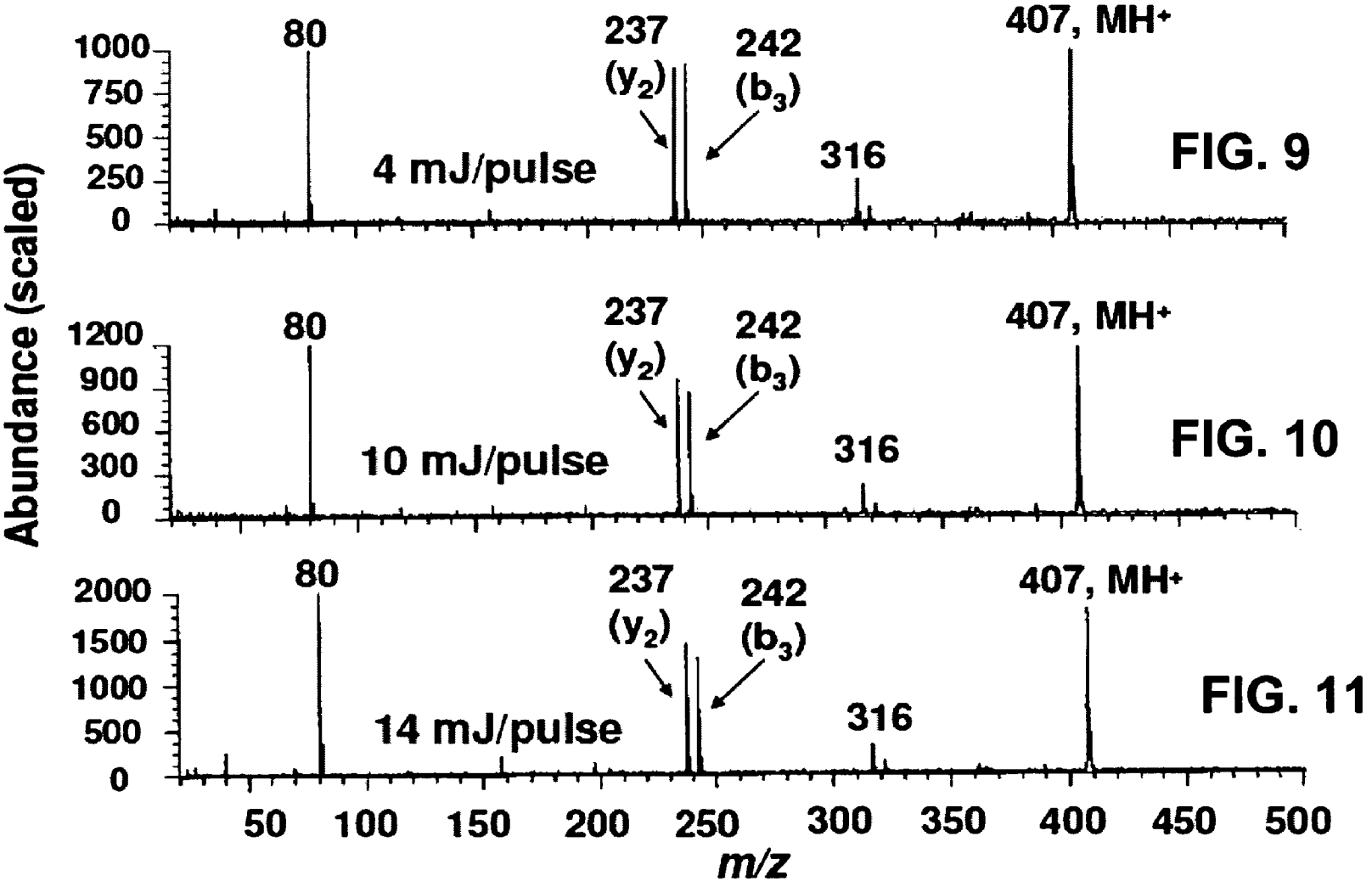
FIGS. 9-11 illustrate improving signal strengths for mass spectra taken when increased power densities are applied to a sample.

FIGS. 9-11 illustrate increased signal strength with increases in power supplied by laser 40. FIG. 9 illustrates the application of a 4 mJ/pulse to the foil target 78. FIG. 10 illustrates the application of a 10 mJ/pulse to the foil target 78. FIG. 11 illustrates the application of a 14 mJ/pulse to the foil target 78. Comparison of FIG. 11 to FIG. 9 shows a substantial increase in signal strength with the higher intensity laser power pulses.

With the previous LIAD techniques, LIAD analyses of hydrocarbon polymer species were limited to analytes with molecular weights below about 1200 amu and biological analytes with molecular weights below about 500 amu. The use of higher laser irradiances with the LIAD probe system 10 of the present invention permits the analysis of a variety of hydrocarbon polymers and saturated petroleum distillates. For example, analysis of the petroleum saturates sample shown in FIG. 14 could not be carried out by using conventional LIAD techniques (no ion signal detected). Higher laser powers enable the investigation of radical reactivity towards biological analytes including peptides, oligonucleotides and nucleosides. In addition to improved desorption efficiency of higher MW components with the use of higher laser powers, increased amount of material is evaporated per laser pulse thus increasing the sensitivity of LIAD analyses.

Depending upon the type of analyte (i.e., nonpolar hydrocarbon polymers, peptides, etc.) being analyzed, different upper mass limits exist for analysis using conventional LIAD techniques. For hydrocarbon polymers, an upper mass limit of approximately 1200 amu exists, whereas with peptides a significantly lower upper mass limit of approximately 500 amu is present. The LIAD probe system 10 of the present invention improves the upper mass limit of LIAD analyses.

The high power LIAD system 10 of the present invention increases the upper mass limit for analysis of hydrocarbon polymers to 1700 amu or higher. The LIAD system 10 of the present invention increases the upper mass limit for analysis of peptides to 1007 amu or higher.

The application of higher laser irradiances (up to at least $5\times10^9$ W/cm$^2$) using the LIAD probe system 10 of the present invention permits the analysis of hydrocarbon and biological polymers in mass spectrometer 12. Examples of the application of this technology in four different areas is illustratively presented herein, including analysis of hydrocarbon polymers, peptides and petroleum components as well as the study of monoradical and biradical reactivity towards LIAD evaporated nucleic acid components. The use of higher laser irradiances improves the desorption efficiency for higher molecular weight components and therefore increases the upper mass limit of analysis for each application area. Additionally, the use of higher laser irradiances increases the overall signal intensities achieved and improves the sensitivity of LIAD analyses.

The experiments detailed here were performed using a Nicolet model FTMS 2000 dual cell FT-ICR mass spectrometer 12 equipped with a 3 T superconducting magnet 14 and a differentially pumped dual cell 16. The FT-ICR utilizes two Edwards Diffstak 160 diffusion pumps 18 (700 L/s), each backed by an Alcatel 2010 (3.2 L/s) dual rotary-vane pump, to maintain a nominal baseline pressure of $<10^{-9}$ torr, inside the vacuum chamber, as measured by two Bayard-Alpert ionization gauges each located on either side of the dual cell 16.

All of the analytes studied herein except for the hydrocarbon polymers, oligonucleotide and petroleum saturates were obtained from Sigma Aldrich (St. Louis, Mo.) and used without purification. The Polywax 500 sample was purchased from Baker-Hughes (Houston, Tex.). The polyisobutylene succinic anhydride (PIBSA) and polyisobutylene phenol (PIB-Phenol) samples were obtained from The Lubrizol Corporation (Wickliffe, Ohio). The oligonucleotide was purchased from The University of British Columbia Biotechnology Laboratory (Vancouver, British Columbia). The petroleum saturates sample was obtained from ExxonMobil Research and Engineering Company (Annandale, N.J.). All chemical ionization reagents and precursors except for the 6,8-dinitroquinoline were also obtained from Sigma Aldrich (St. Louis, Mo.) and used without further purification. The 6,8-dinitroquinoline was synthesized and purified from a literature procedure as documented elsewhere. The Ti sample foil targets target 78 were obtained from Alfa Aesar (Ward Hill, Mass.).

Sample Preparation

Hydrocarbon Polymers

The Polywax 500 samples were prepared by a modified spin-spray method referred to as pneumatically assisted spin-coating. A solution (carbon disulfide) of the polymer was prepared to a concentration of ~1 mg/mL with heating to approximately 46° C. in order to completely dissolve all of the PE. Approximately 1 mL of this solution was sprayed through a silica capillary onto a rotating (~250 rpm) foil (12.7 μm) at a flow rate of ~250-400 μL/min. To assist in the evaporation of the $CS_2$ solvent, a nitrogen sheath gas (~50 psi) was utilized coaxially to the center capillary. Homogeneous polymer coverage was achieved on the foil.

The polyisobutylene succinic anhydride and polyisobutylene phenol samples were prepared using a direct deposition method. Approximately 1 mg of polymer was directly applied to a Ti foil (12.7 μm). The prepared sample foils were then mounted onto the LIAD probe for analysis.

Biopolymers

Sample solutions (methanol) of peptides, oligonucleotides and nucleosides were prepared in concentrations ranging from 1 to 10 mM and electrospray deposited onto Ti metal foils (1.7 cm diam.). By varying the volume of solution spayed, sample thicknesses ranging from 30 to 85 nmol/cm$^2$ were obtained.

Petroleum Saturates

The petroleum saturates samples were prepared using the method of solvent casting. Sample solutions of the petroleum saturates were prepared by dissolving approximately 1 mg of sample in 5 mL of hot carbon disulfide. Approximately 1 mL of the hot saturates solution was deposited on to a Ti foil (12.7 μm) positioned on hot plated heated to ~50° C. The carbon disulfide solvent was allowed to evaporate leaving a thin layer of analyte on the surface of the foil.

FT-ICR Mass Spectrometry Analysis

Following sample preparation, the foil target 78 was mounted onto LIAD probe 30 for analysis. The probe 30 was inserted into the mass spectrometer 12 to within ⅛" of the source trapping plate 34 of the dual-cell 16. The foil target 78 was then subjected to a series of laser shots (fifty to six hundred shots) focused onto the backside of the foil target 78. Laser irradiances on the order of $9\times10^8$ W/cm$^2$ to $5\times10^9$ W/cm$^2$ were obtained on the backside of the foil target 78 resulting in desorption of analyte molecules from the opposite side into the mass spectrometer 12.

With the exception of the petroleum saturates, the LIAD evaporated molecules were ionized by chemical ionization (CI) following desorption into the mass spectrometer 12. The petroleum saturates were ionized by low energy electron impact (EI) performed by switching the bias of a grid to allow electrons (20 eV electron energy, 5-10 μA emission current) into the ICR cell during the laser trigger event (1 ms). Chemical ionization was achieved by reaction of the desorbed analyte molecules with the desired CI reagent ions stored in the ICR cell. With the exception of the protonated pyridine, protonated triethylamine and protonated N,N,N,N-tetramethyl-1,3-diaminopropane obtained by "self"-chemical ionization processes, the bromide anion, cyclopentadienyl radical cation, N-phenyl-3-dehydropyridinium, and the N-methyl-6,8-didehydroquinolinum ions were generated by previously documented procedures and stored in the ICR cell. Unwanted ions were ejected from the cell through the use of stored waveform inverse Fourier transform (SWIFT) excitation pulses. The stored reagent ions were allowed to react with the acoustically desorbed analyte molecules resulting in ionization. A broadband chirp (1.9 kHz to 2.6 MHz, 200 V peak-to-peak, sweep rate 3200 Hz/μs) was used to excite the ions for detection. All data were obtained by collecting 64 k data points with an acquisition rate of 8000 kHz. The mass spectra were subjected to baseline correction, Hanning apodization, and one zero-filling.

Analysis of Hydrocarbon Polymers

Without easily ionizable functional groups (i.e. double bonds or heteroatoms), large (nonvolatile) saturated hydrocarbon polymers are typically difficult to analyze by mass spectrometry.

Polyisobutenyl Succinic Anhydride (PIBSA)

Figure 12A:
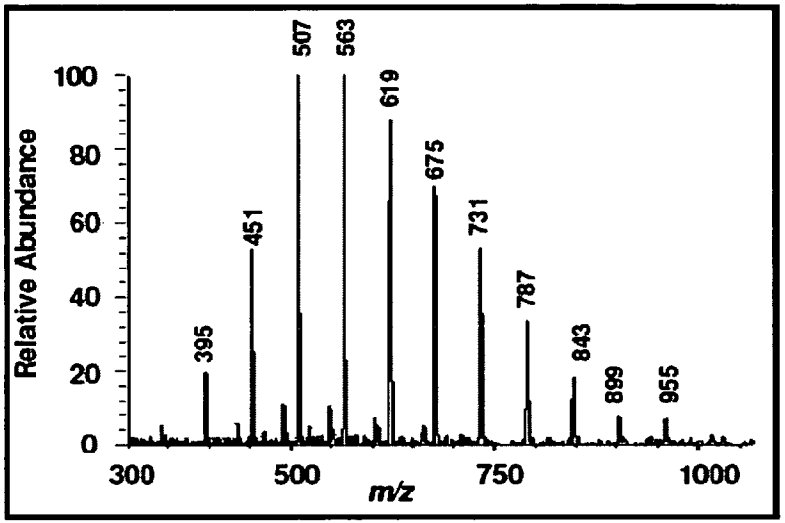
FIG. 12(*a*) illustrates a negative-ion LIAD/CI mass spectrum of polyisobutylene-succinic anhydride (PIBSA) evaporated by a conventional LIAD probe using 150 laser shots of 2.7 mJ/pulse at back of foil and deprotonated with bromide ($Br^-$)
Figure 12B:
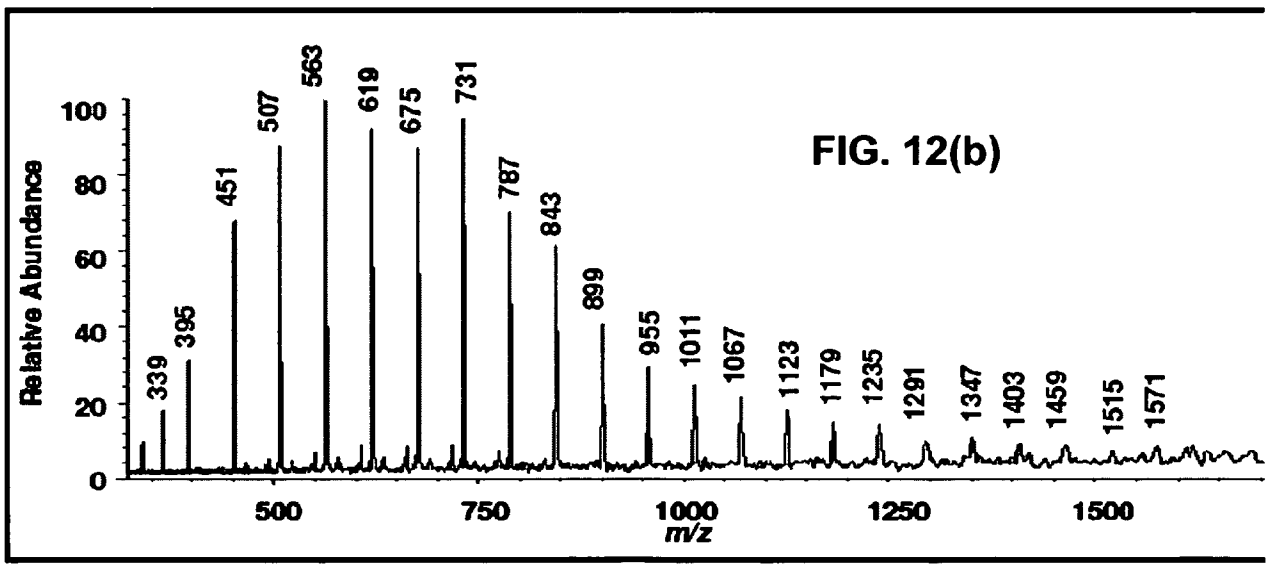

The use of higher laser irradiances with the LIAD probe system 10 has also been applied to the evaporation of higher molecular weight hydrocarbon polymers with derivatized end groups. With an easily ionizable succinic anhydride functionality, mass spectrometric analysis of polyisobutenyl succinic anhydride (PIBSA) polymer (average MW=1000 Da) evaporated via LIAD with deprotonation from bromide anion (Br) was performed as shown in FIGS. 12(*a*) and 12(*b*). A comparison of the results obtained using a conventional LIAD probe shown in FIG. 12(*a*) (150 shots of 2.7 mJ/pulse at back of foil) with those obtained using LIAD probe system 10 of the present invention shown in FIG. 12(*b*) (50 shots of 8 mJ/pulse at back of foil) for evaporation of the material into the mass spectrometer 12 indicates the advantages of the use of higher laser powers. Due to the presence of water in the PIBSA solution prior to analysis and deposition onto the Ti foil, the succinic anhydride end groups were hydrolyzed resulting in the dicarboxylic acid form of the polymer which was deprotonated in the gas phase. As shown in the two spectra of FIGS. 12(*a*) and 12(*b*), higher laser irradiances affords up to twenty four oligomers (n=24) extending up to ~m/z 1600 compared with only eighteen oligomers (n=18) with a maximum m/z of 954 when evaporated from the conventional LIAD probe.

Polyisobutenyl Phenol

Figure 13A:
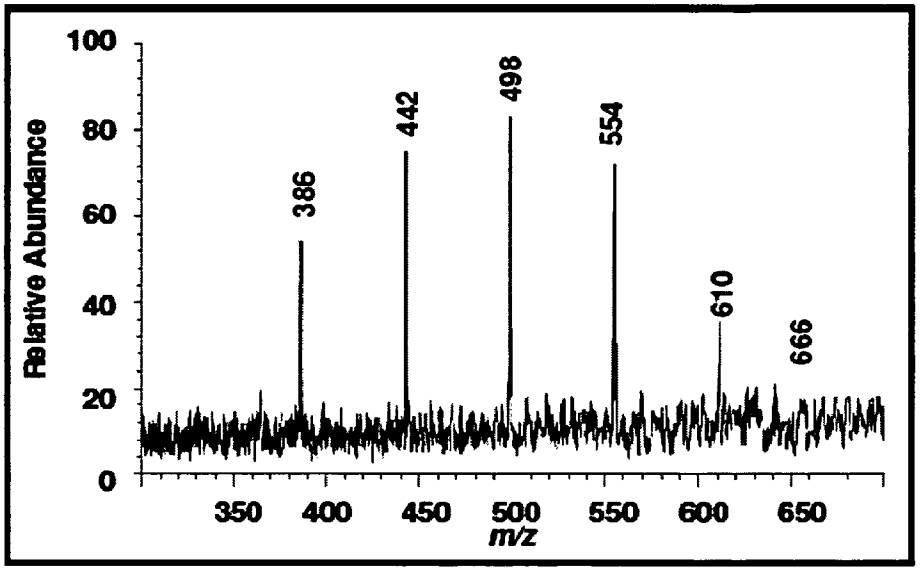
FIG. 13(*a*) illustrates a LIAD/CI mass spectrum of polyisobutylene phenol (PIB-Phenol) evaporated by a conventional fiber LIAD probe using 50 laser shots of 2.7 mJ/pulse at back of foil and ionized by addition of $CpCO^+$.
Figure 13B:
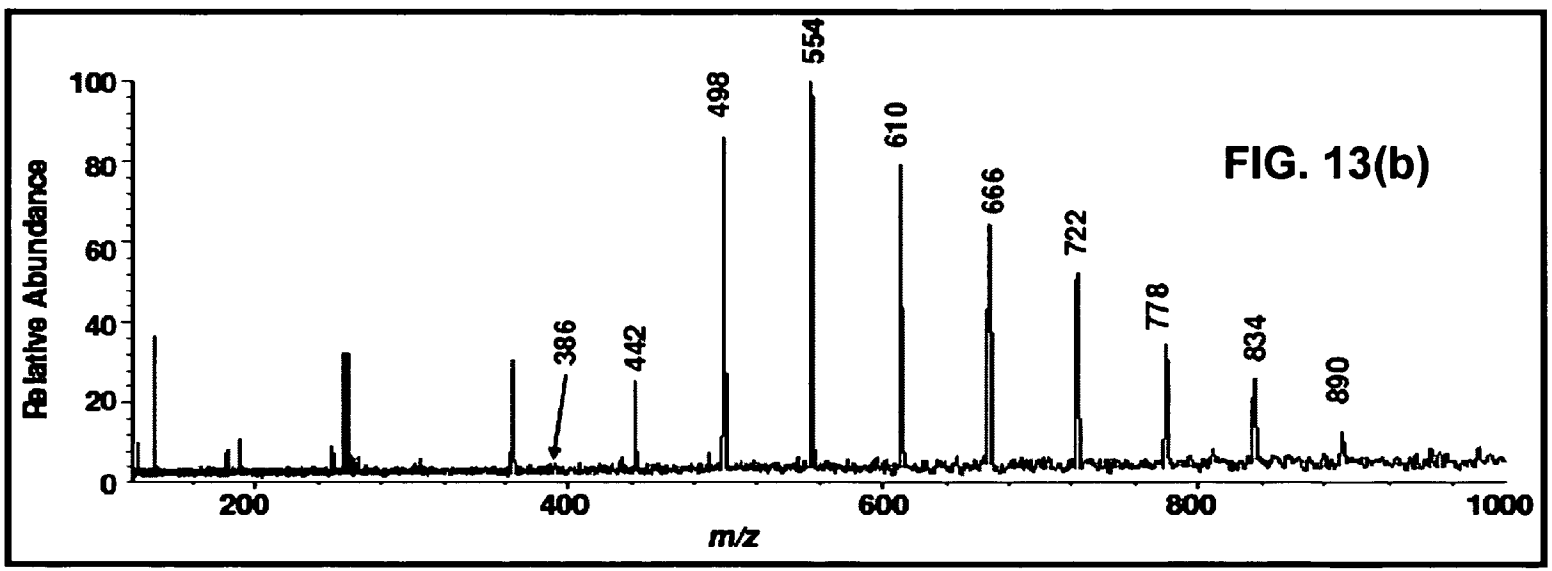

Another functionalized hydrocarbon polymer, polyisobutenyl phenol was also analyzed using the higher laser irradiances of the LIAD probe system 10 of the present invention. With the aromatic end group, this polymer is easily ionized via addition of the $CpCo^{+\cdot}$ moiety to the phenolic ring. FIG. 13(*a*) shows the mass spectra obtained using a conventional LIAD probe with 50 shots of 2.7 mJ/pulse at back of foil. FIG. 13(*b*) illustrates the mass spectra obtained using the LIAD probe system 10 using 50 shots of 8 mJ/pulse at back of foil for evaporation of the material into the mass spectrometer 12. The use of higher laser irradiances aide in the evaporation of higher molecular weight material as represented by the number of oligomers detected. With the LIAD probe 10 of the present invention, n=10 oligomers (up to m/z 890) were detected as shown in FIG. 13(*b*). This is in comparison to a maximum of n=4 oligomers (up to ~m/z 666) observed with the conventional LIAD probe as shown in FIG. 13(*a*). A comparison of the amount of signal obtained with one-third the number of laser shots (50 vs 150 laser shots) applied to the backside of the foil also indicates the improved sensitivity of analysis possible with the use of higher laser irradiances.

Analysis of Petroleum Components

Petroleum Saturates

To evaluate the use of higher laser irradiances, a sample of saturated petroleum components (MW range from 300 to 800 amu) was desorbed into the FT-ICR mass spectrometer 12 with both a conventional LIAD probe and a LIAD probe 30 of the present invention (fiber and fiberless) and ionized by low-energy EI (20 eV). The petroleum saturates sample contains cyclic and acyclic paraffins. Analysis of the petroleum saturates sample with conventional LIAD techniques and ionization by low-energy EI yielded no detectable ion signals (data not shown). However, with the use of higher laser irradiances with the LIAD probe system 10 (8 mJ/pulse at backside of foil), ion signals in the 500 to 700 m/z range were detected as illustrated in FIG. 14. As in previous LIAD/EI analyses of petroleum components, the sensitivity of these high m/z ions is relatively low due to ion-ion repulsions (space charging) as well as low ionization efficiency with low EI energies. Increasing the ionization energy (70 eV) significantly reduced the intensity of the high m/z ions due to substantial fragmentation. By removing any low mass ions (m/z 17 to 400) through application of a high frequency sweep, the sensitivity of the high m/z ions was increased as shown in FIG. 14.

Analysis of Biological Molecules

Peptides

The volatilization of high-mass peptides (Angiotensin II antipeptide, MW 899, and angiotensin 1, MW 1296) by conventional LIAD techniques was performed, however these results did not yield detectable ion signals in the FT-ICR mass spectrometer 12 when subjected to ionization by EI or stored CI reagent ions. Utilizing the conventional LIAD probes, the largest peptide successfully analyzed with this approach is met-enkephalin (MW 573). This peptide was evaporated via LIAD and deprotonated by the chloride anion ($Cl^-$). Utilizing the positive-ion mode, the largest peptide successfully analyzed with LIAD/CI with the conventional LIAD probe is val-ala-ala-phe (MW 406).

Angiotensin II Antipeptide (glu-qlv-val-tvr-val-his-pro-val)

Figures 15A, 15B, 15C:
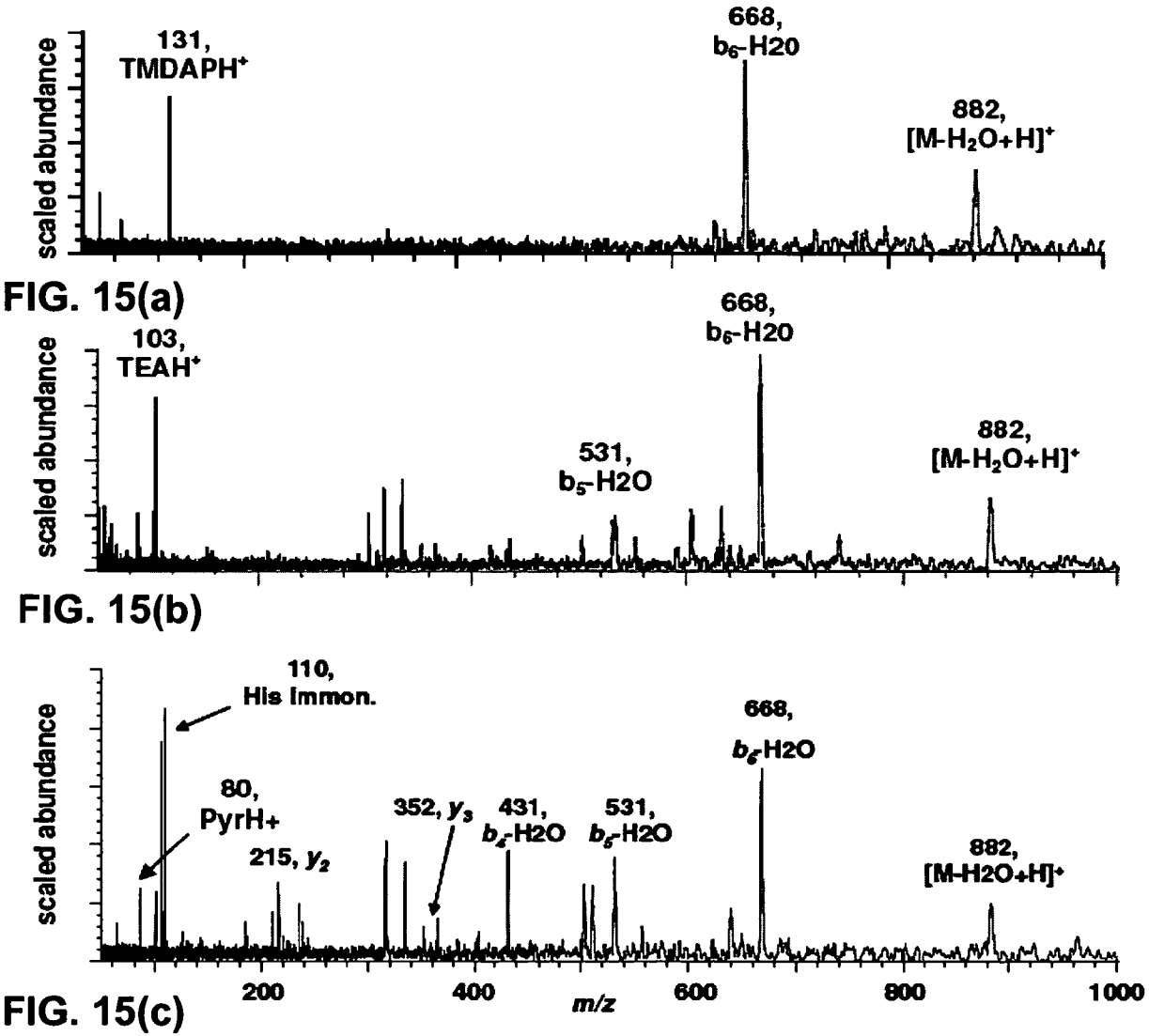
FIG. 15(*a*)-15(*c*) illustrate LIAD/CI mass spectra of the octapeptide angiotensin 11 antipeptide (glu-gly-val-tyr-val-his-pro-val, MW 899) evaporated by 100 laser shots of 7.5 mJ/pulse (at back of foil) and ionized via protonated N,N,N,N-tetramethyl-1,3-diaminopropane (TMDAPH+,m/z 131) as shown in FIG. 15(*a*); protonated triethylamine (TEAH+, m/z 103) as shown in FIG. 15(*b*); and protonated pyridine($PyrH^+$, m/z 80) as shown in FIG. 15(*c*)

To further evaluate the effectiveness of the use of higher laser powers with the LIAD probe system 10 of the present invention for the analysis of higher molecular weight peptides, the peptide, Angiotensin II antipeptide (MW 899) was chosen. This octapeptide of sequence glu-gly-val-tyr-val-his-pro-val was evaporated from the LIAD probe system 10 of the present invention with 200 laser shots (7.5 mJ/pulse at the back of foil) and ionized via several proton transfer reagents of varying basicity. FIG. 15(*a*) illustrates the sample ionized via protonated N,N,N,N-tetramethyl-1,3-diaminopropane (m/z 131, PA=247.4 kcal/mol). FIG. 15(*b*) illustrates the sample ionized via protonated triethylamine (m/z 103, PA=234.7 kcal/mol). FIG. 15(*c*) illustrates the sample ionized via protonated pyridine (m/z 80, PA=222.0 kcal/mol). Due to the amino-terminal glutamic acid residue, the peptide undergoes loss of water through the cyclization of the amino terminus as indicated by the observed dehydrated molecular ion ($[M-H_2O+H]^+$, m/z 882) and fragment ion signals including the $b_6$-$H_2O$ (m/z 667), $b_5$-$H_2O$ (m/z 531) and $b_4$-$H_2O$ (m/z 431). As the exothermicity of the protonation reaction is decreased through the use of CI reagents with higher proton affinities, the degree of fragmentation is significantly reduced.

Trinucleotide (dApdApdA)

Figure 16:
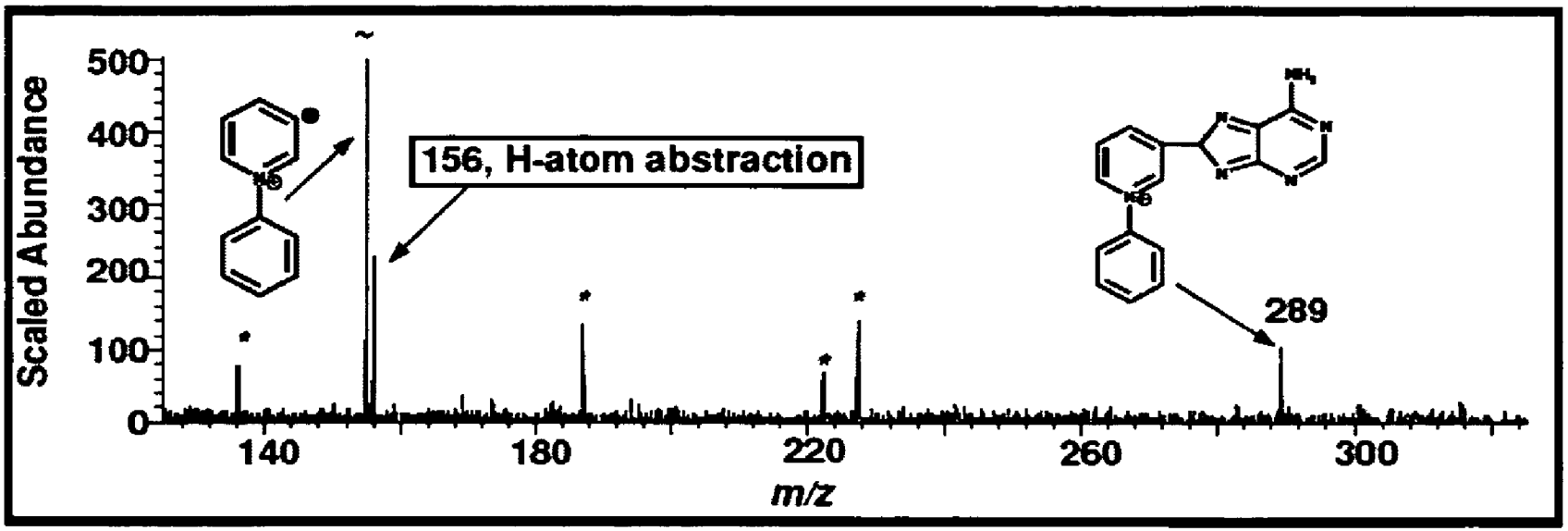
FIG. 16 illustrates reaction of the oligonucleotide dApdApdA (MW 877), desorbed via the LIAD probe of the present invention using 200 laser shots of 3 mJ/pulse, with the electrophilic N-phenyl-3-dehydropyridinium radical 1.
Figure 17:
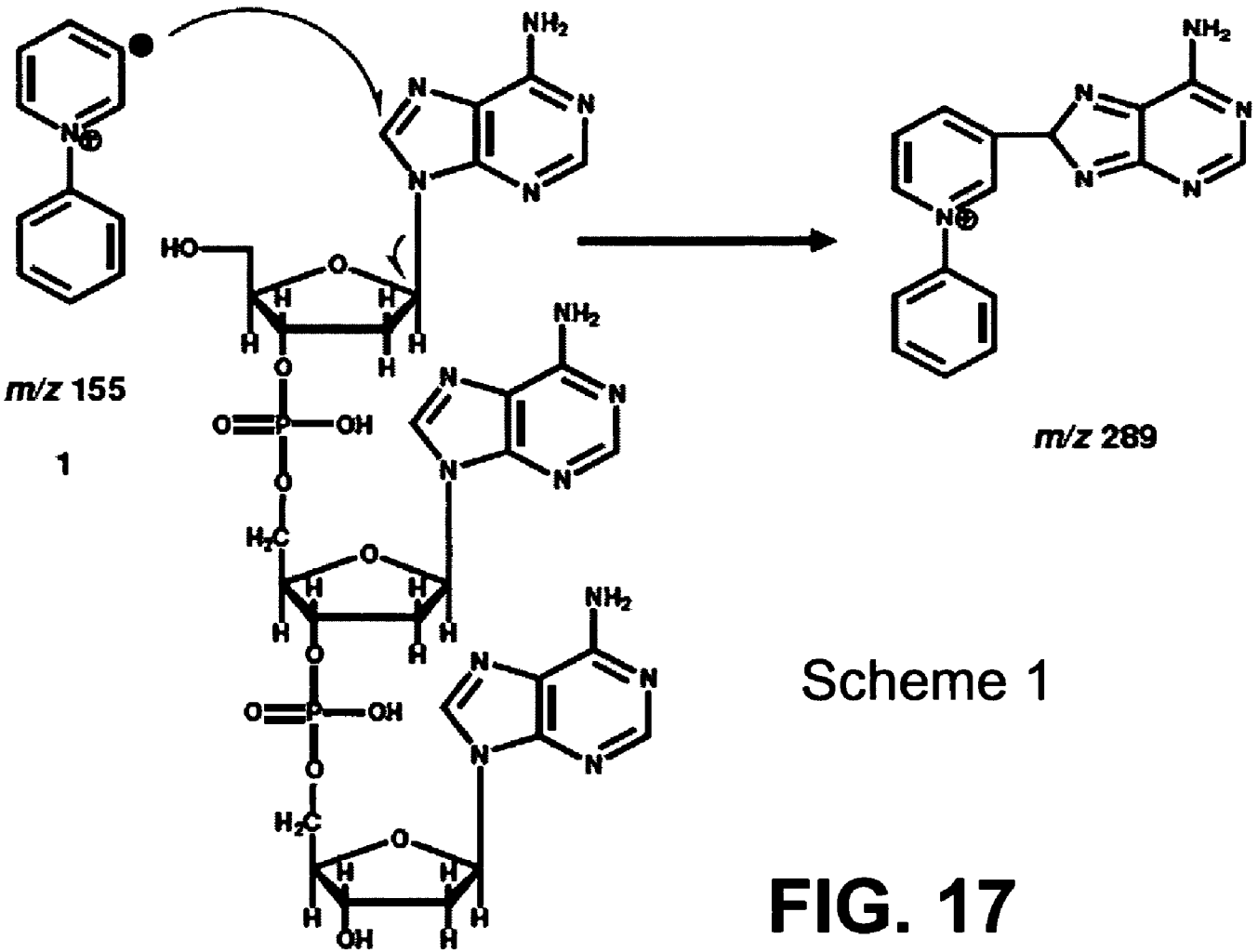
FIG. 17 illustrates Scheme 1 associated with the reaction of FIG. 16.

To assess the use of higher laser powers with the LIAD probe system 10 of the present invention for the evaporation of larger biomolecules, the charged phenyl radical N-phenyl-3-dehydropyridinium ion (1) was allowed to react with the fiberless LIAD evaporated trinucleotide dApdApdA in the gas phase. The electrospray deposited trinucleotide sample (10 nmol/cm$^2$) was mounted onto the end of the fiberless LIAD probe and inserted into the mass spectrometer. The oligonucleotide was evaporated from the Ti foil target 78 surface with 200 laser shots (3 mJ/pulse at backside of foil) while continuously rotating the foil target 78. As shown in FIG. 16, hydrogen atom abstraction by the phenyl radical (m/z 156) as well as addition to the nucleobase followed by elimination of the rest of the molecule (m/z 289) was observed. FIG. 17 illustrates further details of Scheme 1. These results are consistent with both solution studies as well as previous gas phase studies examining the reactivity of charged phenyl radical (1) with the dinucleotide dApdA. Previous examinations of charged phenyl radical reactions with DNA components (nucleobases, sugars) (1) indicated that H-atom abstraction occurs predominantly from the sugar moiety in nucleosides.

DeoxyGuanosine

Figure 18A:
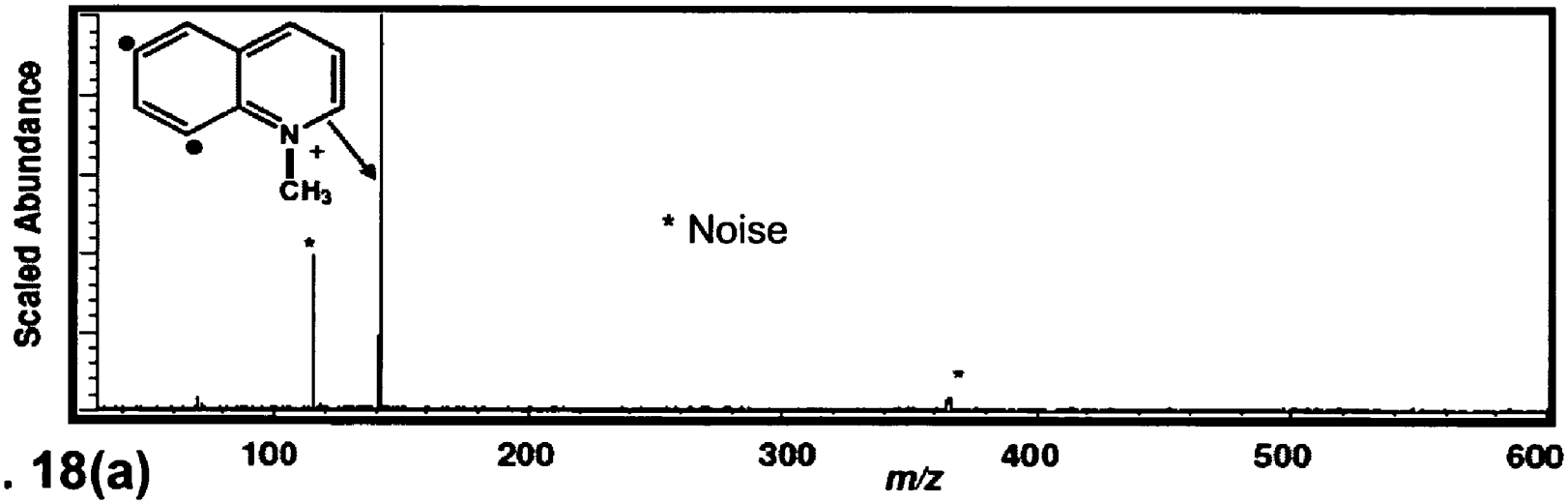
FIG. 18(*a*) illustrates a reaction of dGuanosine (MW 267), evaporated by the conventional LIAD probe using 600 laser shots of 2.7 mJ/pulse at back of foil and with N-methyl-6,8-didehydroquinolinium ion.
Figure 18B:
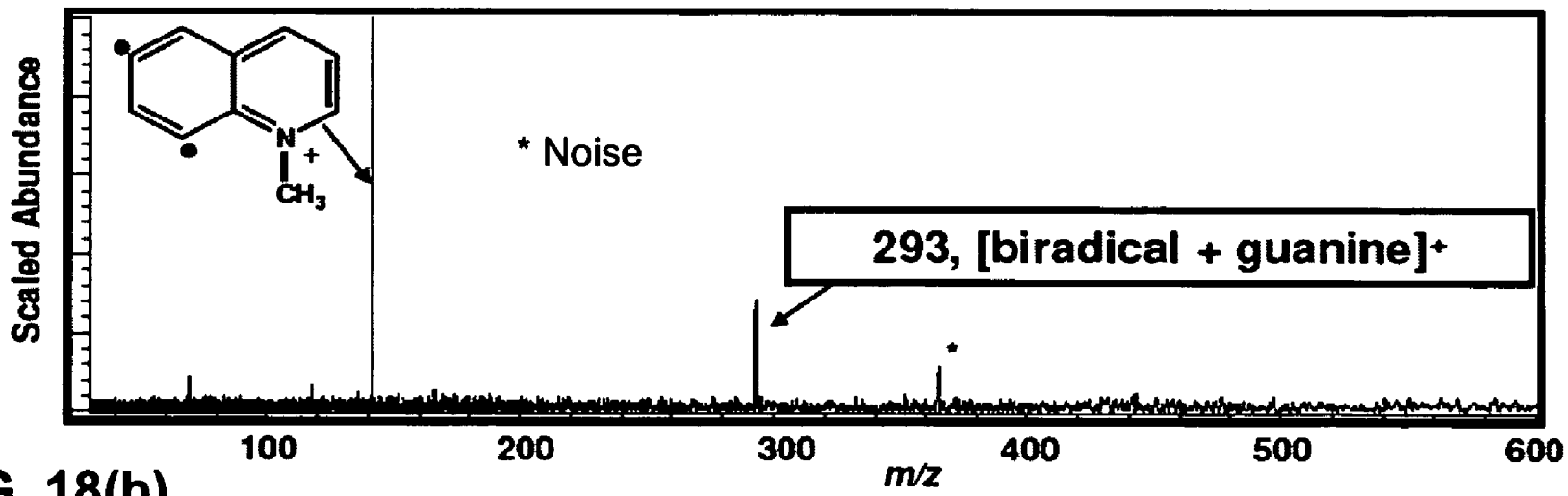
Figure 19:
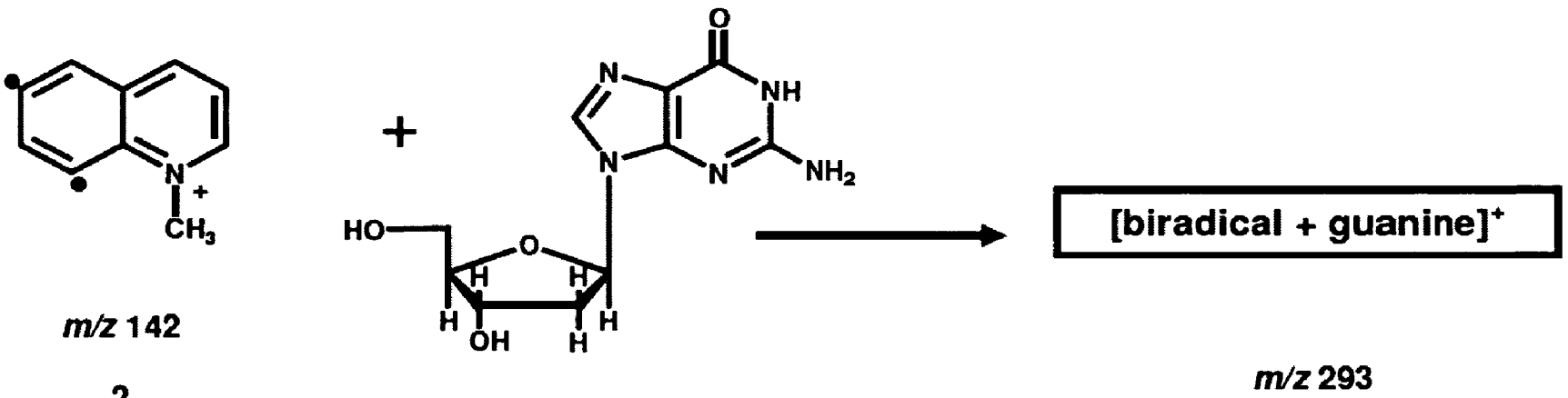
FIG. 19 illustrates Scheme 2 associated with the reaction of FIGS. 18(*a*) and 18(*b*)

To further extend the examination of radical reactivity towards biomolecules, the reactive biradical N-methyl-6,8-didehydroquinolinum ion (2) shown in FIG. 19 was allowed to react with the LIAD evaporated nucleoside deoxyGuanosine. The biradical (2) was obtained in the gas phase through previously documented procedures. Upon initial examination utilizing the conventional LIAD probe to evaporate the nucleoside into the gas phase, no reaction products were observed as illustrated in FIG. 18(*a*) even following utilization of up to 600 laser shots applied to the backside of the foil. Further examination of this reaction utilizing higher laser powers (4 mJ/pulse on the backside of the foil) with the LIAD probe system 10 for evaporation of the nucleoside into the gas phase revealed strong product ion signal corresponding to addition of the biradical to the nucleoside followed by elimination of the rest of the molecule (m/z 289, Scheme 2) as shown in FIG. 18*b*. Scheme 2 is illustrated in FIG. 19. Utilization of only 200 laser shots with the LIAD probe system 10 (as opposed to 600 laser shots with the conventional LIAD probe and no products detected) indicates improved analysis sensitivity with the LIAD probe system 10. The use of higher laser powers with the LIAD probe system 10 improves the efficiency of desorption and was qualitatively shown to evaporate more material per laser pulse when higher laser powers are employed.

DeoxyAdenosine

Figure 20A:
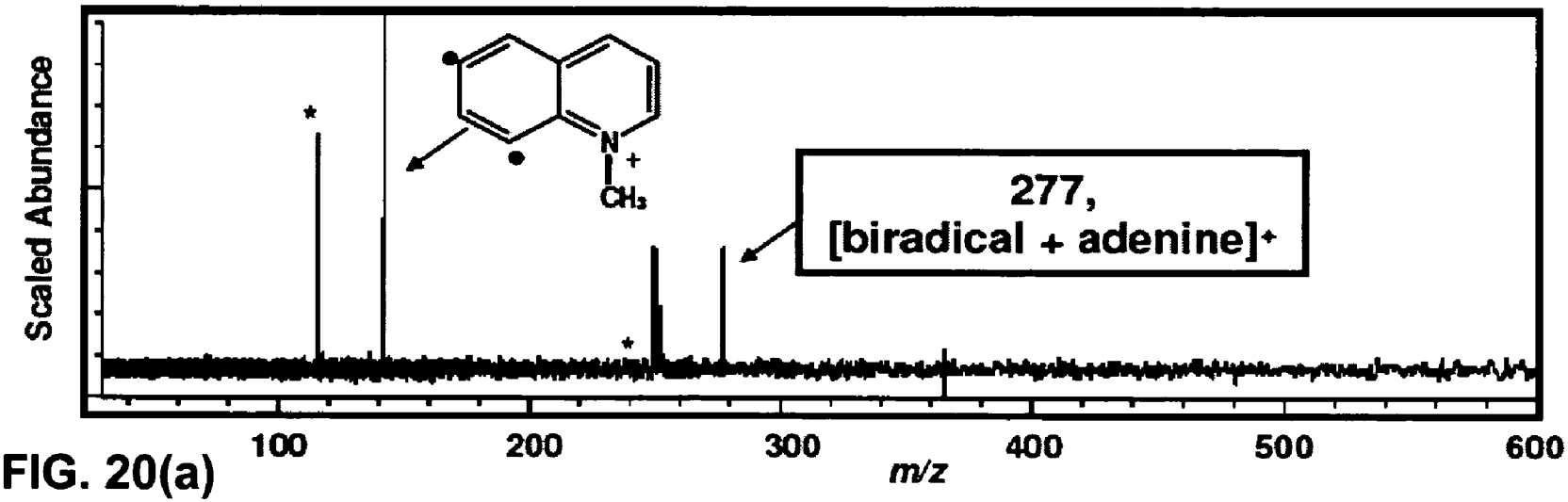
FIG. 20(*a*) illustrates a reaction of dAdenosine (MW 251) evaporated by a conventional LIAD probe using 400 laser shots of 2.7 mJ/pulse at back of foil, with N-methyl-6,8-didehydroquinolinium ion.
Figure 20B:
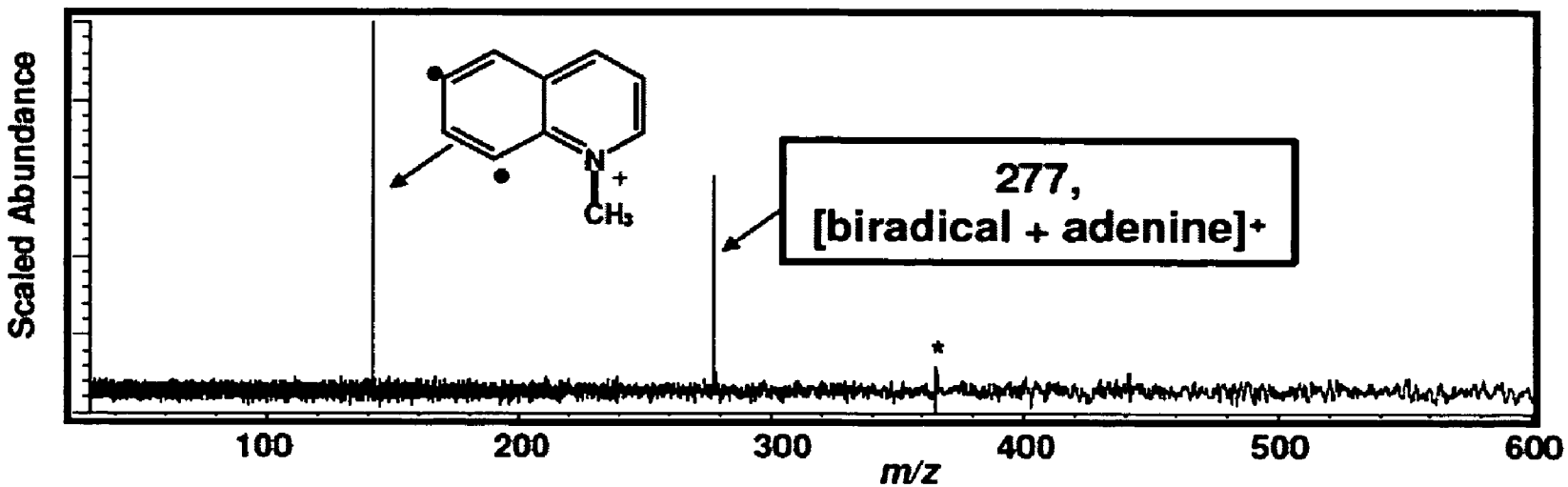
Figure 21:
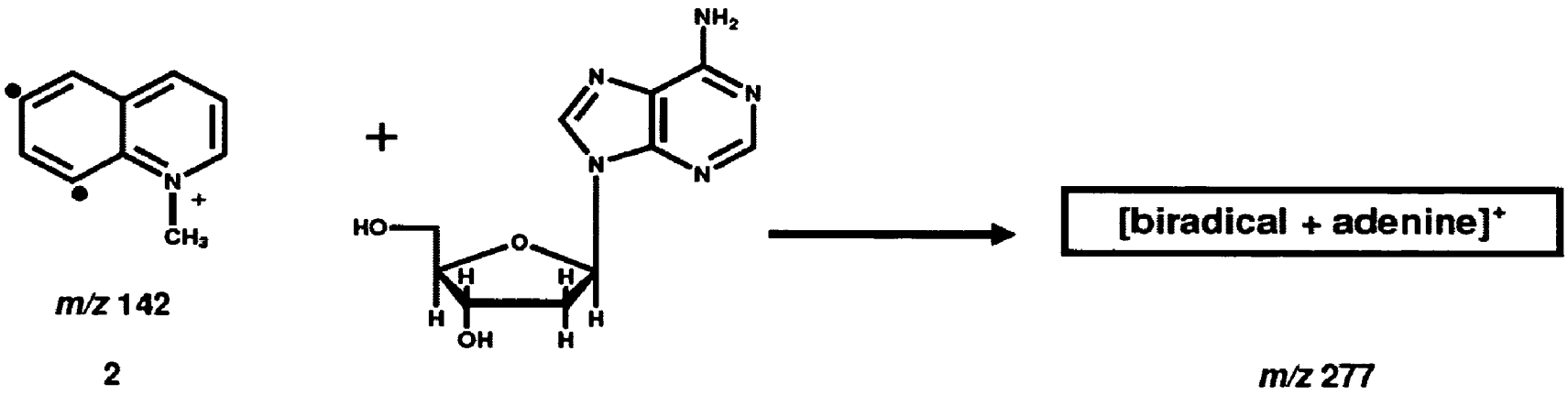
FIG. 21 illustrates Scheme 3 associated with the reaction of FIGS. 20(*a*) and 20(*b*).

Additional examination of the biradical reactivity of the N-methyl-6,8-didehydroquinolinumion (2) shown in FIG. 21 towards additional nucleosides was also performed. In an identical manner, the biradical was allowed to react with a conventional LIAD evaporated nucleoside deoxyAdenosine with the application of 400 laser shots (to the backside of the foil) product ion signal for addition of the biradical to the nucleoside followed by elimination of the sugar moiety (m/z 277) (Scheme 3, FIG. 21) was observed as shown in FIG. 20(*a*). With a modest increase in laser irradiance applied to the back of the foil target 78 with the LIAD probe system 10 (4.0 mJ/pulse at backside of foil), increased product ion signal was observed for the ion-molecule reaction as shown in FIG. 20(*b*). The number of laser shots required to obtain sufficient product ion signal with the LIAD probe system 10 (200 laser shots) is half of that required with the use of the conventional LIAD probe (400 laser shots). As demonstrated here, this analyte with a relatively low molecular weight (MW 251) can be adequately evaporated with the conventional LIAD probe. However, the use of higher laser powers with the LIAD probe system 10 offers advantage over the conventional probe through the evaporation of more material per laser pulse using the higher laser powers. This feature of the LIAD probe system 10 is useful when studying ion-molecule reactions which proceed with low efficiencies (slow rates of reaction). In addition to the improved desorption efficiency for higher MW analytes, the increased sensitivity with the fiberless LIAD probe improves its overall utility.

While this invention has been described as having exemplary designs or embodiments, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

Although the invention has been described in detail with reference to certain illustrated embodiments, variations and modifications exist within the scope and spirit of the present invention as described and defined in the following claims.

What is claimed is:

1. A laser-induced acoustic desorption (LIAD) probe configured to desorb neutral molecules into a mass spectrometer, the probe comprising:

a body portion having an interior region, a first end, and a second end configured to be inserted into a mass spectrometer;

a window coupled to the second end of the body portion;

a laser configured to generate a series laser pulses which pass into the first end of the body portion and through the window along a desorption axis; and a movable sample holder located adjacent the second end of the body portion spaced apart from the window, the movable sample holder being configured to receive a target having an analyte sample thereon and to move the target relative to the desorption axis so that different portions of the target and analyte sample thereon move into the path of the laser beam pulses during a desorption process, wherein the laser pulses supply energy to the target and an induced wave causes mechanical stress and desorption of the analyte sample from the target.

2. The probe of claim 1, further comprising a focusing lens located in the interior region of the body portion, the series of laser pulses passing through the focusing lens prior to passing through the window.

3. The probe of claim 1, further comprising a controller which moves the sample holder in X and Y directions within a plane transverse to the desorption axis.

4. The probe of claim 3, wherein the controller moves the sample holder in a raster pattern within the plane.

5. The probe of claim 1, further comprising a controller which rotates the sample holder about an axis of rotation spaced apart from the desorption axis.

6. The method of claim 1, wherein the series of laser pulses are introduced into the body portion without the use of a fiber optic line.

7. The method of claim 1, wherein the target has first and second sides and the analyte sample is located on the first side of the target, the series of laser pulses generating a power density greater on the second side of the target which ranges from about $9\times10^8$W/cm$^2$ to about $5.0\times10^9$ W/cm$^2$.

8. A method of desorbing an analyte sample into a mass spectrometer using laser-induced acoustic desorption (LIAD), the method comprising:

providing a LIAD probe to supply a series of pulses along a desorption axis;

providing a target having an analyte sample located thereon;

positioning the target in the path of the series of laser pulses; and providing relative movement between the desorption axis and the target so that different portions of the target and analyte sample are aligned with the desorption axis during a desorption process, the laser pulses supplying energy to the target and an induced wave causing mechanical stress and desorption of the analyte sample from the target.

9. The method of claim 8, further comprising the step of ionizing neutral molecules desorbed from the analyte sample on the target after the desorption process.

10. The method of claim 8, wherein the series of laser pulses are introduced into the LIAD probe without the use of a fiber optic line.

11. The method of claim 8, wherein the step of providing relative movement between the desorption axis and the target includes rotating the target about an axis of rotation spaced apart from the desorption axis.

12. The method of claim 8, wherein the step of providing relative movement between the desorption axis and the target includes rotating the LIAD probe relative to the target about an axis of rotation spaced apart from the desorption axis.

13. The method of claim 8, wherein the step of providing relative movement between the desorption axis and the target includes moving the target in X and Y directions within a plane transverse to the desorption axis.

14. The method of claim 8, wherein the target has first and second sides and the analyte sample is located on the first side of the target, the series of laser pulses generating a power density on the second side of the target which ranges from about $9\times10^8$ W/cm$^2$ to about $5.0\times10^9$ W/cm$^2$.

15. A laser-induced acoustic desorption (LIAD) apparatus configured to desorb neutral molecules into a mass spectrometer, the apparatus comprising:

a laser which generates a series of laser pulses; and a probe including a body portion having an interior region, a first end, and a second end configured to be inserted into a mass spectrometer, the probe also including a window coupled to the second end of the body portion and a target holder located adjacent the second end of the body portion spaced apart from the window, the body portion being positioned relative to the laser so that the series of laser pulses enters the first end directly without the use of a fiber optic line, pass through the window and strike a target held by the target holder, thereby inducing a wave causing mechanical stress to desorb neutral molecules from an analyte sample on the target.

16. The apparatus of claim 15, further comprising:

a frame coupled to the laser;

an external focusing lens coupled to the frame; and at least one external mirror coupled to the frame, the at least one external mirror being aligned to reflect the series of laser pulses emitted from the laser through an opening in the first end of the probe.

17. The apparatus of claim 15, further comprising an internal focusing lens located in the interior region of the body portion, the body portion being aligned so that the series of laser pulses pass through the internal focusing lens prior to passing through the window.

18. The apparatus of claim 17, further comprising first and second internal mirrors located within the interior region of the body portion, the first and second internal mirrors being positioned to reflect the series of laser pulses entering the first end of the body portion to change an axis of the series of laser pulses within the body portion from an entry axis to a spaced apart desorption axis, the desorption axis passing through the internal focusing lens, the window, and the target holder.

19. The apparatus of claim 18, wherein the body portion includes an inner cylinder and an outer cylinder rotatable relative to the inner cylinder, and wherein the inner cylinder, the first and second internal mirrors, and the focusing lens are held in a fixed position and the outer cylinder and the target holder are rotatable about an axis of rotation spaced apart from the desorption axis to move the target relative to the desorption axis during a desorption process.

20. The apparatus of claim 18, wherein the body portion includes an outer cylinder and an inner cylinder rotatable relative to the outer cylinder, and wherein the outer cylinder and the target holder are held in a fixed position and the inner cylinder, the first and second internal mirrors, and the focusing lens are rotatable about an axis of rotation spaced apart from the desorption axis to move the desorption axis relative to the target during a desorption process.

21. A method of desorbing a sample into a mass spectrometer using laser-induced acoustic desorption (LIAD), the method comprising:

providing a target having first and second sides;

providing an analyte sample on the first side of the target;

positioning the target adjacent a portion of the mass spectrometer; and desorbing neutral molecules from the analyte sample on the first side of the target using a high power LIAD probe to focus a series of laser pulses along a desorption axis and generate a power density greater than $9\times10^8$ W/cm$^2$ second side of the target, and wherein an induced wave causes mechanical stress and desorption of neutral molecules from the analyte sample of the first side of the target.

22. The method of claim 21, further comprising ionizing the neutral molecules after the desorbing step.

23. The method of claim 21, wherein the power density generated by the LIAD probe on the second side of the target ranges from about $9\times10^8$ W/cm$^2$ to about $5.0\times10^9$ W/cm$^2$.

24. The method of claim 21, wherein the LIAD probe generates a plurality of laser pulses on the second side of the target, the pulses having an energy of greater than 4.5 mJ/pulse.

25. The method of claim 21, wherein the LIAD probe generates a plurality of laser pulses on the second side of the target, the pulses having an energy in a range of about 4 mJ/pulse to about 13 mJ/pulse.

26. The method of claim 21, wherein the analyte sample is a peptide having a molecular weight greater than 500 amu.

27. The method of claim 21, wherein the analyte sample is a peptide having a molecular weight ranging from about 500 amu to about 1000 amu.

28. The method of claim 21, wherein the analyte sample is a hydrocarbon polymer having a molecular weight greater than 1200 amu.

29. The method of claim 21, wherein the analyte sample is a hydrocarbon polymer having a molecular weight ranging from about 1200 amu to about 1700 amu.

30. The method of claim 21, further comprising providing relative movement between the desorption axis and the target so the different portions of the target and the analyte sample are aligned in the path of the series of laser pulses along the desorption axis during a desorption process.

* * * * *

UNITED STATES PATENT AND TRADEMARK OFFICE

CERTIFICATE OF CORRECTION

PATENT NO. : 7,619,217 B2
APPLICATION NO. : 11/807400
DATED : November 17, 2009
INVENTOR(S) : Ryan C Shea et al.

It is certified that error appears in the above-identified patent and that said Letters Patent is hereby corrected as shown below:

In column 1, line 3, insert the following notice:

--This invention was made with government support under Grant No. R01GM052418 awarded by the National Institutes of Health (NIH). The government may have certain rights to the invention.--.

In column 18, line 27 claim 1, insert the word --of-- between the words "series" and "laser".

Signed and Sealed this

Ninth Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,619,217 B2
APPLICATION NO. : 11/807400
DATED : November 17, 2009
INVENTOR(S) : Ryan C Shea et al.

It is certified that error appears in the above-identified patent and that said Letters Patent is hereby corrected as shown below:

Col. 1 line 3 should read

-- This invention was made with government support under Grant No. R01GM052418 awarded by National Institutes of Health (NIH). The government has certain rights in the invention. --

Signed and Sealed this
Twelfth Day of April, 2011

David J. Kappos

David J. Kappos
*Director of the United States Patent and Trademark Office*